US005647326A

United States Patent [19]

Kato et al.

[11] Patent Number: 5,647,326

[45] Date of Patent: Jul. 15, 1997

[54] FUEL INJECTION PUMP

[75] Inventors: Hiroaki Kato; Hidekatsu Yashiro; Tsuyoshi Kodama, all of Saitama Prefecture, Japan

[73] Assignee: Zexel Corporation, Japan

[21] Appl. No.: 529,764

[22] Filed: Sep. 18, 1995

[30] Foreign Application Priority Data

Sep. 21, 1994 [JP] Japan ..... 6-251614

[51] Int. Cl.[6] ..... F02M 37/04; F02M 59/20

[52] U.S. Cl. ..... 123/500; 417/499

[58] Field of Search ..... 123/445, 446, 123/500–1, 503, 299–300; 417/490, 495, 499

[56] References Cited

U.S. PATENT DOCUMENTS

| | | | |
|---|---|---|---|
| 4,975,029 | 12/1990 | Hatz | 123/299 |
| 5,209,208 | 5/1993 | Siebert et al. | 123/503 |
| 5,219,280 | 6/1993 | Yashiro | 417/499 |
| 5,286,178 | 2/1994 | Schaef | 417/490 |
| 5,487,651 | 1/1996 | Guentert et al. | 123/499 |
| 5,558,067 | 9/1996 | Blizard et al. | 123/501 |

FOREIGN PATENT DOCUMENTS

| | | |
|---|---|---|
| 0453227 | 4/1991 | European Pat. Off. . |
| 2-115565 | 4/1990 | Japan . |
| 6-50237 | 2/1994 | Japan . |

OTHER PUBLICATIONS

Patent Abstracts of Japan Fuel Injection Pump, vol. 18 No. 283, May 30, 1994.

*Primary Examiner*—Thomas N. Moulis

*Attorney, Agent, or Firm*—Ostrolenk, Faber, Gerb & Soffen, LLP

[57] ABSTRACT

In a fuel injection pump equipped with a plunger producing preflow effect, pressurized fuel is delivered at least in the low engine speed region by driving the plunger using a region of a cam on the decreasing velocity side of its maximum velocity point. As a result, the fuel delivery rate is reduced during low-speed engine operation and increased during high-speed engine operation, providing an ideal fuel delivery rate for an indirect-injection type engine equipped with swirl chambers or auxiliary chambers.

20 Claims, 22 Drawing Sheets

FUEL INJECTION PUMP

BACKGROUND OF THE INVENTION

1. Field of the Invention

This invention relates to a fuel injection pump, more particularly to a fuel injection pump providing a fuel delivery rate suitable for an indirect-injection type engine in which fuel is indirectly injected into the engine cylinders.

2. Prior Art

A generally preferred feature of a fuel injection pump is that it be capable of advancing the start of fuel injection (fuel injection advance) during high-speed engine operation. Some of the fuel injection pumps with this feature have a fuel injection timing regulation mechanism that is part of the fuel injection pump itself and therefore do not require a separate timer (automatic advance device) for regulating the injection timing.

Some of these timing regulation mechanisms utilize the preflow effect arising at high engine speed to establish a fuel injection advance characteristic. (The preflow effect is a dynamic effect (throttle effect) which causes pressurized fuel to be delivered prior to the closure of the fuel feed hole.)

Fuel injection pumps with plungers that utilize the preflow effect are taught, for example, by Japanese Patent Public Disclosure Nos. Hei 6-50237 and Hei 2-115565.

The fuel injection pump of Patent Public Disclosure No. Hei 6-50237 will be explained with reference to FIGS. 35 to 39.

FIG. 35 is a vertical sectional view of a fuel injection pump 1 and FIGS. 36 and 37 are enlarged sectional views of essential portions thereof. The fuel injection pump 1 has a pump housing 2, a cam 4 mounted on a cam shaft 3 connected with an engine (not shown), a fuel injection quantity control rack 5, a plunger barrel 6, a plunger 7, a delivery valve 8 and a delivery valve holder 9.

The cam 4 is rotated by the engine through the cam shaft 3 and vertically reciprocates the plunger 7 via a tappet roller 10. The tappet roller 10 and the plunger 7 are constantly forced downward in the figure toward the cam 4 by a plunger spring 11.

The control rack 5 is linked with an accelerator pedal through a governor (neither shown) such that its position in the direction perpendicular to the drawing sheet varies with the degree of accelerator pedal depression. The movement of the control rack 5 is transferred through a fuel injection quantity control sleeve 12 to rotate the plunger 7 about its own axis by a corresponding angle.

The plunger barrel 6 is fixed inside the pump housing 2 and the plunger 7 is accommodated inside the plunger barrel 6 to be free to reciprocate vertically and rotate about its own axis. A fuel reservoir 13 is formed between the plunger barrel 6 and the pump housing 2 and a fuel chamber 14 is formed between the plunger 7 and the delivery valve 8.

The plunger barrel 6 is formed with a feed hole comprising a main port 15 and a sub-port 16.

FIG. 36 is an enlarged vertical sectional view showing the main port 15 at the time of closure and FIG. 37 is an enlarged sectional view showing the sub-port 16 at the time of closure. As illustrated, the upper edge 15A of the main port 15 and the upper edge 16A of the sub-port 16 are at the same height or horizontal level. They are formed over an interval of 180 degrees in the circumferential direction.

The upper edge 16A of the sub-port 16 can, as occasion demands, instead be located at a lower level than the upper edge 15A of the main port 15.

When the plunger 7 reciprocates within the plunger barrel 6, fuel is drawn into the fuel chamber 14 from the fuel reservoir 13 and pressurized therein, whereupon the delivery valve 8 opens and pressurized fuel is delivered to a fuel injection nozzle (not shown) through a fuel injection pipe 17 (FIG. 35).

The peripheral portion at the head of the plunger 7 is formed with a vertical passage 18 communicating with the fuel chamber 14, an inclined lead groove 19 communicating with the vertical passage 18 and an upper sub-lead groove 21 communicating with the fuel chamber 14.

FIG. 37 is an enlarged view of an essential portion showing the sub-port 16 at the time point when it is closed by the arrival of the upper edge 21A of the upper sub-lead groove 21 at its upper edge 16A.

The upper sub-lead groove 21 can be brought opposite the sub-port 16 both during "normal operation" and starting.

"Normal operation" is defined as low-load and high-load operation other than starting and to extend from low-speed operation, such as idling, to high-speed operation and high idling (an operating state in which the quantity of fuel injection is reduced by the governor when the engine exceeds its rated high-speed, high-load operating region).

In the fuel injection pump 1 of this configuration, fuel is sucked from the fuel reservoir 13 through the main port 15 and the sub-port 16 and into the fuel chamber 14 when the plunger 7 moves downward.

When the plunger 7 thereafter moves upward, pressurization of the fuel in the fuel chamber 14 begins from the point that the upper end 7A of the plunger 7 closes off the main port 15 and the upper edge 21A of the upper sub-lead groove 21 closes off the sub-port 16. Delivery of pressurized fuel stops when the main port 15 communicates with the inclined lead groove 19.

The portion of the stroke of the plunger 7 between its bottom dead point and the point at which pressurized fuel delivery starts is the prestroke and the portion thereof between closure of the sub-port 16 and the opening of the main port 15 is the effective stroke. Thus the depth (height) of the upper sub-lead groove 21 is the prestroke L1.

During idling or other such low-speed operation, the sub-port 16 is in communication with the upper sub-lead groove 21, so that substantial delivery of pressurized fuel starts after the sub-port 16 is closed by the upper edge 21A of the upper sub-lead groove As the engine speed increases and a high-speed operating engine condition arises, the throttling effect of the sub-port 16 causes pressurized fuel delivery to start before the sub-port 16 is completely closed by the upper edge 21A of the upper sub-lead groove 21. As a result, fuel injection is advanced. This is the preflow effect mentioned earlier.

Since the fuel injection pump 1 of this configuration achieves the preflow effect by utilizing the throttling characteristic of the sub-port 16, however, it has the problem discussed below.

First, consider FIGS. 38 and 39, which are graphs showing how cam velocity (corresponding to fuel delivery rate) varies with cam angle in cams with different profiles. FIG. 38 shows the curves for a tangential cam and an arc cam, while FIG. 39 shows the curve for another type of cam.

As shown, the time points at which the main port 15 and the sub-port 16 close fall in the cam angle region preceding the maximum velocity point of the cam.

Specifically, during high-speed engine operation, delivery of pressurized fuel by the preflow effect starts from the time point of FIG. 36, namely, at cam angle θ1 in FIGS. 38 and 39, the angle at which the main port 15 is closed (but the sub-port 16 is still open). During low-speed engine operation, on the other hand, delivery of pressurized fuel starts from the time point of FIG. 37, namely, from cam angle θ3, the angle at which the ascending plunger 7 closes the sub-port 16.

FIGS. 40 and 41 are graphs showing how fuel delivery rate varies with the cam angle of cams 4 with different profiles. FIG. 42 is sectional view of a cam 4 having the profile of FIG. 40. Since the fuel delivery rate is proportional to (cam velocity x sectional area of the plunger 7), the curves in FIGS. 40 and 41 substantially follow the same pattern of change as those in FIGS. 38 and 39.

In FIGS. 40 and 41, defining the cam angle at which delivery of pressurized fuel starts (the time point at which the main port 15 is closed) during high-speed engine operation as θ1, the cam angle at which delivery of pressurized fuel terminates (the time point at which the main port 15 is opened) during high-speed engine operation as θ2, the cam angle at which delivery of pressurized fuel starts (the time point at which the sub-port 16 is closed) during low-speed engine operation as θ3, and the cam angle at which delivery of pressurized fuel terminates (the time point at which the sub-port 16 is opened) during low-speed engine operation as θ4, it follows that the cam angles θ1, θ2, θ3 and θ4 are located between the cam angle θ0 at which ascent of the fuel delivery rate begins and cam angle θmax, the maximum velocity point (also see FIG. 42).

In other words, the preflow effect is utilized in the region where the cam velocity is rising from left to right in the graphs, namely, in the region preceding the maximum velocity point. As a result, the fuel delivery rate is low at high engine speed and high at low engine speed.

More specifically, the average fuel delivery rate at the high-speed, high-load rated point and at the rated point between closing and opening of the main port 15 during high idling (the rated point average cam velocity Vcm) is lower than the average fuel delivery rate at the low-speed, low-load torque point and the torque point (torque point average cam velocity Vcs) between closing and opening of the sub-port 16 during low idling.

This phenomenon does not cause much of a problem in the direct-injection type engine in which fuel is injected directly into the engine cylinders since the air capacity inside the cylinders is large. In indirect-injection type engines equipped with swirl chambers or auxiliary combustion chambers, however, it causes numerous problems owing to the relatively small air capacity of the swirl chambers or auxiliary combustion chambers. These problems are particularly pronounced during low-speed operation and include generation of black smoke at the torque point and decreased power output at the rated point.

The fuel injection pump utilizing the preflow effect taught by the aforesaid Japanese Patent Public Disclosure No. Hei 2-115565 will now be briefly explained, particularly as regards its stepped plunger 25, with reference to FIGS. 43 and 44.

FIGS. 43 and 44 are sectional views of an essential portion of the stepped plunger 25 inside a plunger barrel 6 having a barrel port 26 (corresponding to the main port 15). As shown, the upper end portion of the plunger 25 is formed with a small-diameter portion. FIG. 43 shows the stepped plunger 25 at a position in which the upper end 25A of the small diameter portion closes the barrel port 26 of the plunger barrel 6. FIG. 44 shows the stepped plunger 25 at a position in which the stepped portion 25B of the stepped plunger 25 closes the barrel port 26.

FIG. 43 corresponds to the time of delivery of pressurized fuel during high-speed engine operation and FIG. 44 to the time of delivery of pressurized fuel during low-speed engine operation. Since, similarly to the case of the plunger 7 explained with reference to FIGS. 36 to 42, the preflow effect of the stepped portion 25B is utilized at a time when the cam velocity is increasing, the fuel delivery rate is low at high engine speed and high at low engine speed, which is particularly undesirable in a indirect-injection type engine.

This invention was accomplished for overcoming the aforesaid problem of the prior art and has as one of its object to provide a fuel injection pump equipped with a plunger utilizing the preflow effect, which reduces the fuel delivery rate at low engine speed and increases the fuel delivery rate at high engine speed.

Another object of the invention is to provide a fuel injection pump which produces a fuel delivery rate particularly suitable for an indirect-injection type engine equipped with swirl chambers or auxiliary combustion chambers.

Another object of the invention is to provide a fuel injection pump which achieves a speed timer function by the preflow effect.

SUMMARY OF THE INVENTION

For achieving these objects, this invention provides a fuel injection pump which utilizes a region of a cam on the decreasing velocity side of its maximum velocity point in the reciprocation of its plunger.

A first aspect of the invention provides a fuel injection pump comprising a pump housing formed with a fuel reservoir, a cam attached to a cam shaft rotated by an engine, a plunger barrel mounted in the pump housing and formed with a fuel feed hole which communicates with the fuel reservoir, a plunger accommodated in the plunger barrel to be capable of sliding reciprocation and rotation therein and being formed with an inclined lead groove at a position for communication with the feed hole, and a fuel chamber formed between the plunger and the plunger barrel, reciprocation of the plunger by the cam causing fuel to be sucked into the fuel chamber from the fuel reservoir and delivered under pressure to a fuel injection nozzle, the fuel injection pump being characterized in that delivery of pressurized fuel by the plunger in a high engine speed region starts at an angle of the cam which precedes the angle thereof at which delivery of pressurized fuel by the plunger in a low engine speed region starts and that at least a pressurized fuel delivery region of the plunger in the low engine speed region is provided from at or after a maximum velocity point of the cam.

The feed hole of the plunger barrel can be formed of a large-diameter main port and a small-diameter sub-port.

The feed hole of the plunger barrel can be constituted of a large-diameter main port and a small-diameter sub-port formed within a range of opening of the main port in the axial direction of the plunger and an orifice be formed for communicating the sub-port with the fuel chamber.

A second aspect of the invention provides a fuel injection pump comprising a pump housing formed with a fuel reservoir, a cam attached to a cam shaft rotated by an engine, a plunger barrel mounted in the pump housing and formed with a fuel feed hole which communicates with the fuel reservoir, a plunger accommodated in the plunger barrel to be capable of sliding reciprocation and rotation therein and being formed with an inclined lead groove at a position for communication with the feed hole, and a fuel chamber formed between the plunger and the plunger barrel, reciprocation of the plunger by the cam causing fuel to be sucked into the fuel chamber from the fuel reservoir and delivered under pressure to a fuel injection nozzle, the fuel injection pump being characterized in that the feed hole of the plunger barrel is formed of a larger-diameter main port and a smaller-diameter sub-port and that at least a pressurized fuel delivery region of the plunger in the low engine speed region is provided from at or after a maximum velocity point of the cam.

The cam velocity in the region of the cam used for closing and opening the main port by the plunger can be made higher than the cam velocity in the region of the cam used for closing and opening the sub-port by the plunger.

A third aspect of the invention provides a fuel injection pump comprising a pump housing formed with a fuel reservoir, a cam attached to a cam shaft rotated by an engine, a plunger barrel mounted in the pump housing and formed with a fuel feed hole which communicates with the fuel reservoir, a plunger accommodated in the plunger barrel to be capable of sliding reciprocation and rotation therein and being formed with an inclined lead groove at a position for communication with the feed hole, and a fuel chamber formed between the plunger and the plunger barrel, reciprocation of the plunger by the cam causing fuel to be sucked into the fuel chamber from the fuel reservoir and delivered under pressure to a fuel injection nozzle, the fuel injection pump being characterized in that a head portion of the plunger is formed with a stepped portion and that at least a pressurized fuel delivery region of the plunger in the low engine speed region is provided from at or after a maximum velocity point of the cam.

Any of various cam profiles can be selected and combined with any of various plungers for obtaining the preflow effect.

In the fuel injection pump according to this invention, the plunger is reciprocated using a cam wherein a region of the cam on the decreasing velocity side of its maximum velocity point, namely, a region from at or after the maximum velocity point of the cam, is used for delivery of pressurized fuel by the plunger at least in the low engine speed region. In other words, use is made of the portion of the cam profile which follows the maximum velocity point at the peak and falls from left to right with increasing cam angle.

This enables the fuel delivery rate during high engine speed operation, which is affected by the closing time of the main port, to be increased relative to the fuel delivery rate during low engine speed operation, which is affected by the closing time of the sub-port that occurs after the closing of the main port. The result is an improvement in the fuel injection characteristics, particularly in an indirect-injection type engine.

In addition, by using the plunger barrel formed with the main port and the sub-port together with a plunger formed with an upper sub-lead groove or the stepped plunger formed with the stepped portion, there can be obtained a fuel injection pump which exhibits preflow effect and functions as a speed timer capable of adjusting the injection timing in response to engine speed.

DETAILED DESCRIPTION OF THE PREFERRED EMBODIMENTS

The fuel injection pump according to this invention will now be explained with reference to FIGS. 1 to 6. Portions similar to those shown in FIGS. 35 to 44 are assigned the same reference symbols as in FIGS. 35 to 44 and are not explained further.

Figure 1:
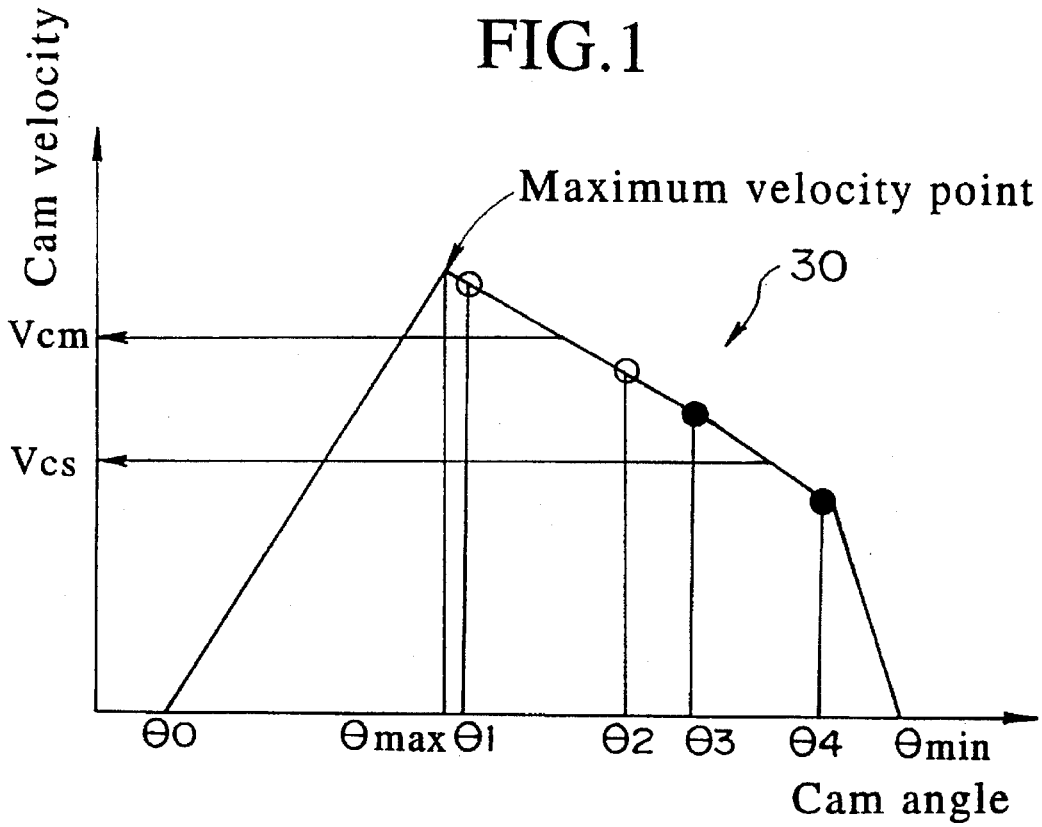
FIG. 1 is a graph showing the cam profile 30 of a cam (first example) used in the fuel injection pump according to this invention, the graph showing how cam velocity varies with cam angle.

FIG. 1 is a graph showing the cam profile 30 of a first example of a cam 4 used in the fuel injection pump according to this invention, the graph showing how cam velocity varies with cam angle.

As illustrated, the cam angle at which delivery of pressurized fuel starts during high engine speed operation, the cam angle at which this delivery of pressurized fuel terminates, the cam angle at which delivery of pressurized fuel starts during low engine speed operation and the cam angle at which this delivery of pressurized fuel terminates are defined in the order mentioned as θ1, θ2, θ3 and θ4 on the portion of the cam profile 30 after the maximum velocity point.

Figure 2:
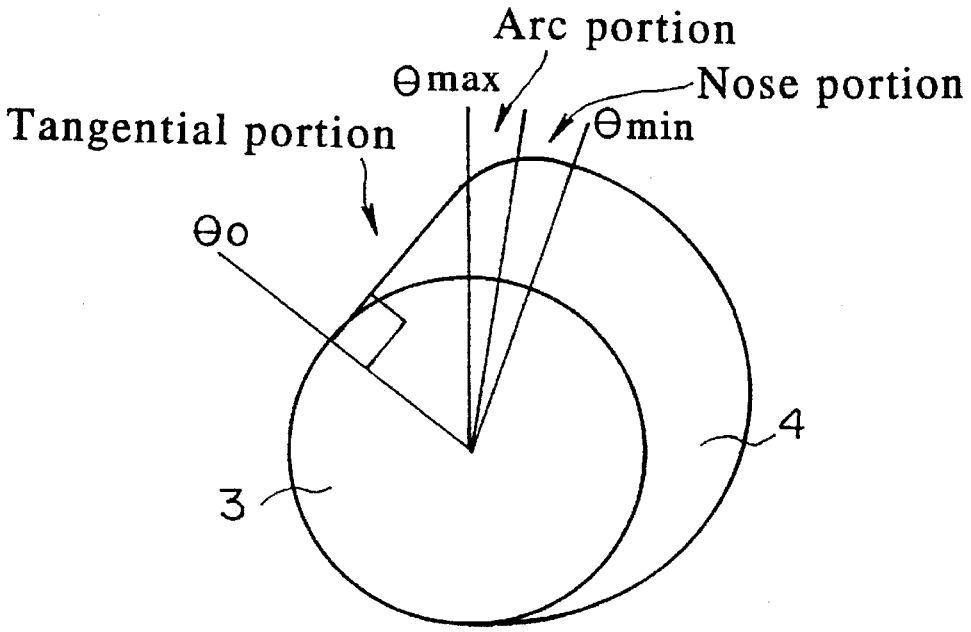
FIG. 2 is a sectional view of the cam having the cam profile 30 of the first example.

FIG. 2 is a sectional view of the cam having the cam profile 30 of the first example. The attachment angle between the cam shaft 3 and the cam 4 and the cam 4 profile itself are appropriately determined as matters of design so as to obtain the cam angles θ1, θ2, θ3 and θ4 shown in FIG. 1 in cooperation with the plunger 7.

It can be seen that the cam angle region following the maximum velocity point can be expanded and the degree of design freedom increased by shortening the tangential portion of the cam located to the left of the maximum velocity point.

Designing the cam profile in the foregoing manner makes it possible to make the average cam velocity (fuel delivery rate) during high engine speed operation greater than the average cam velocity (fuel delivery rate) during low engine speed operation.

Figure 3:
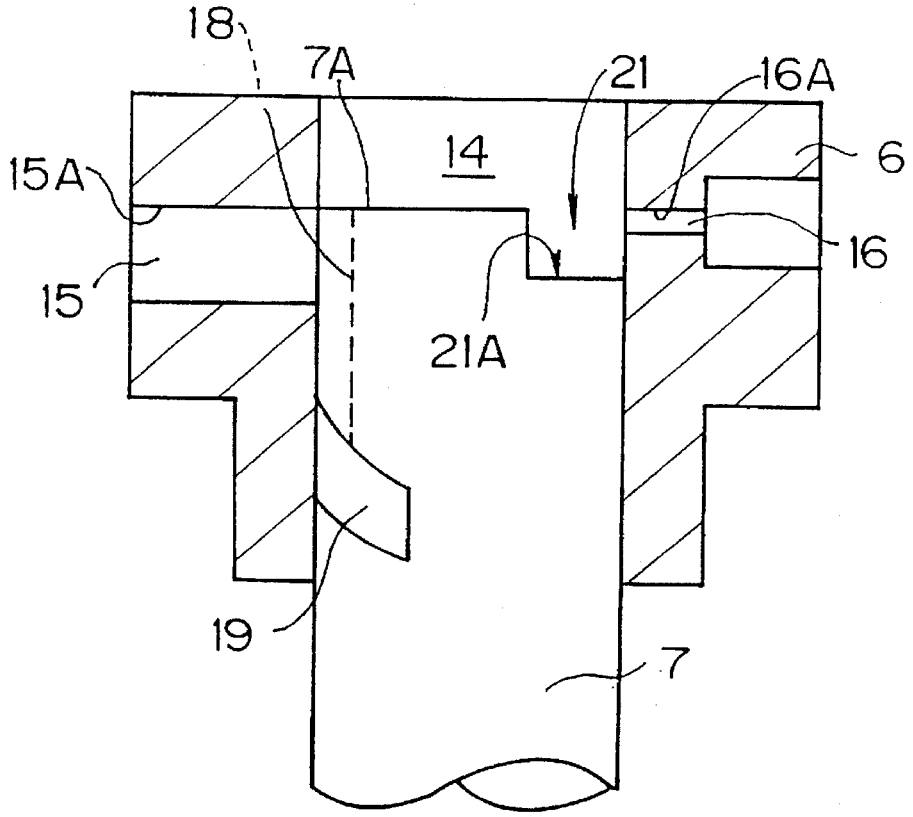
FIG. 3 is an enlarged sectional view of an essential portion of a plunger 7 which is a first example of a plunger for use with the first cam (the plunger 7 being substantially the same as that shown in FIG. 36).
Figure 4:
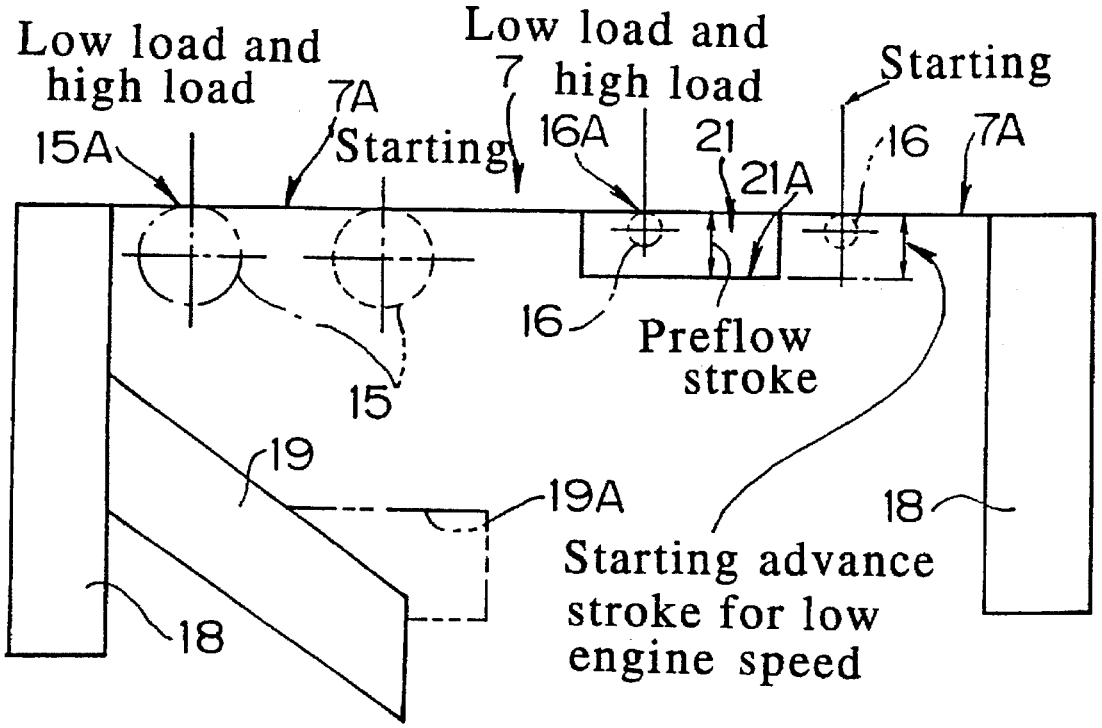
FIG. 4 is a development of lead grooves at the head portion of the plunger 7.
Figure 36:
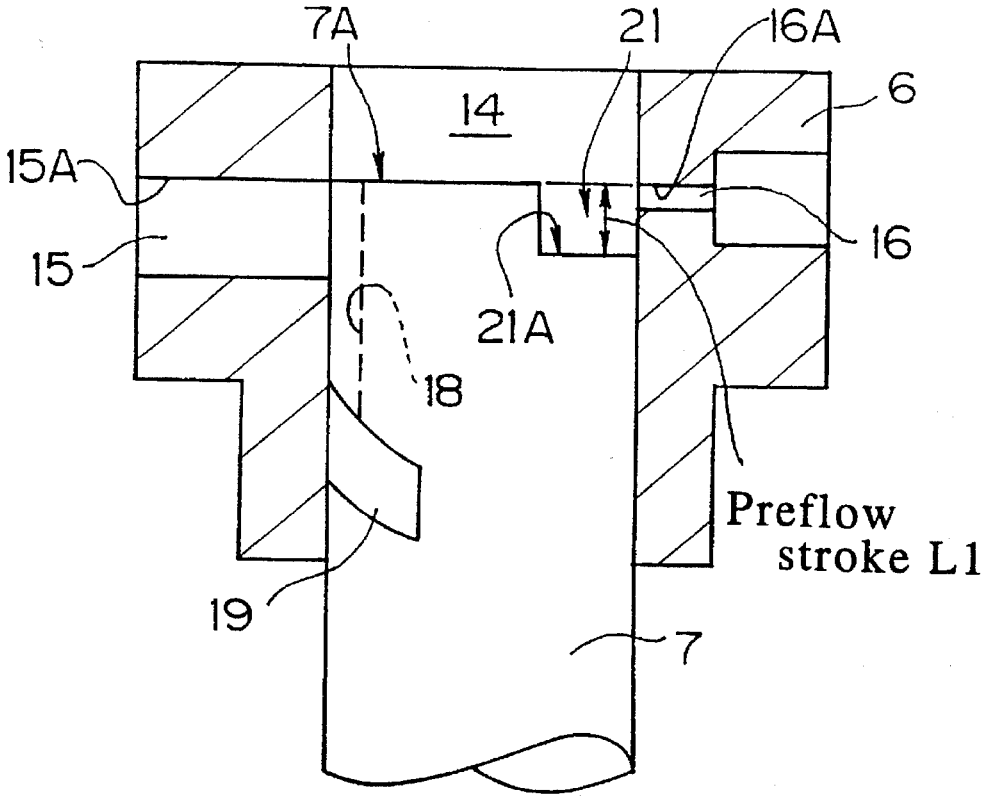
FIG. 36 is an enlarged vertical sectional view of an essential portion of the fuel injection pump 1 showing a main port 15 at the time of closure.
Figure 37:
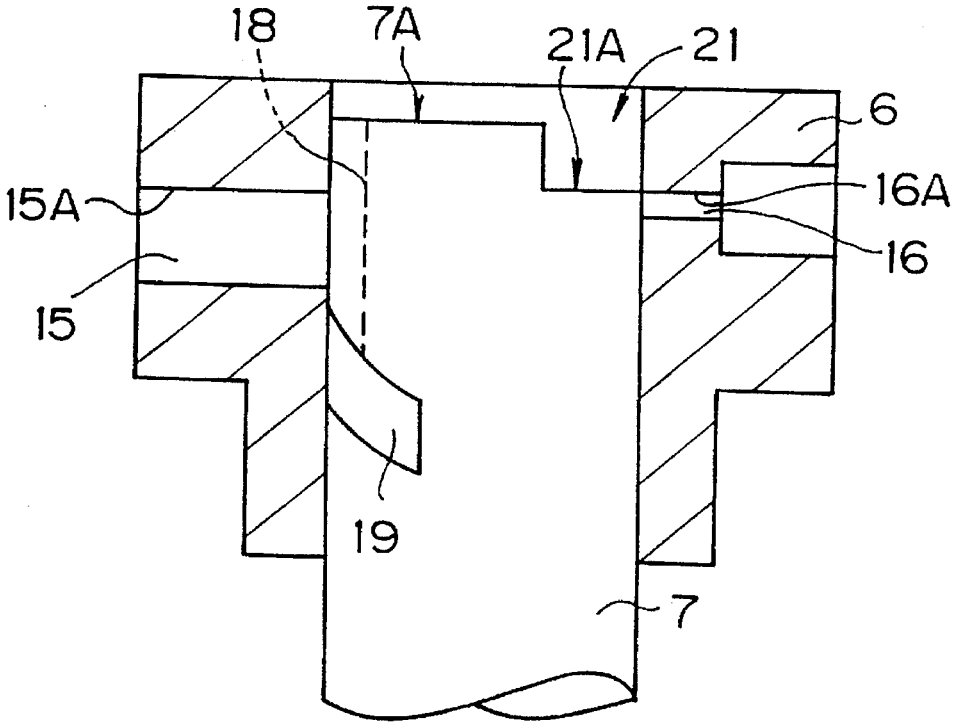
FIG. 37 is an enlarged sectional view of an essential portion of the fuel injection pump 1 showing a sub-port 16 at the time of closure.
Figure 38:
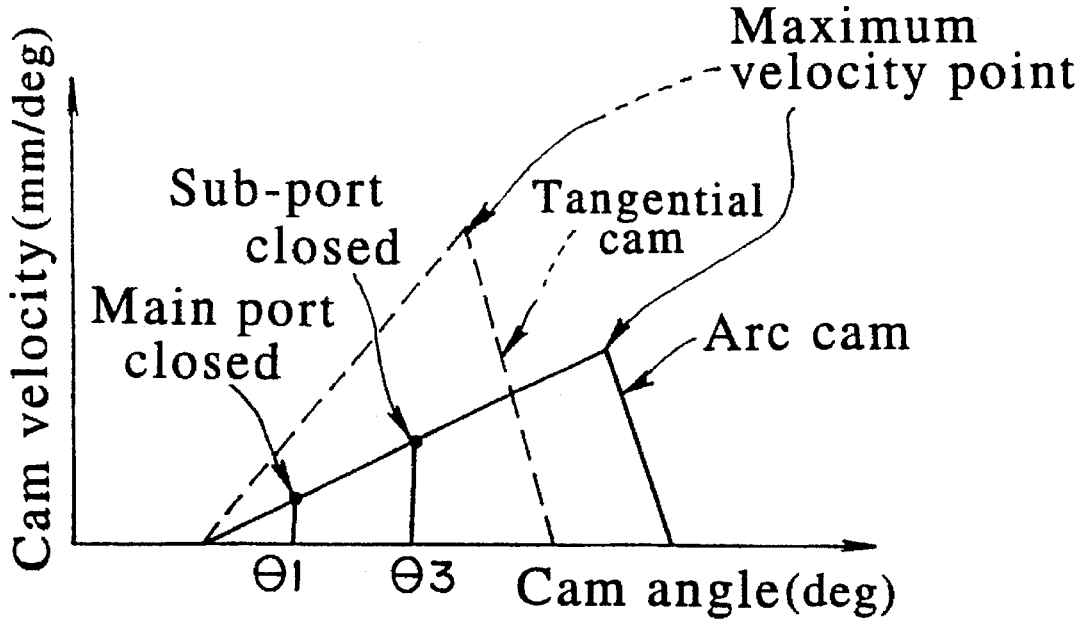
FIG. 38 is a graph showing how cam velocity (corresponding to fuel delivery rate) varies with cam angle in the cases of using a cam with a tangential profile and a cam with an arc profile.
Figure 39:
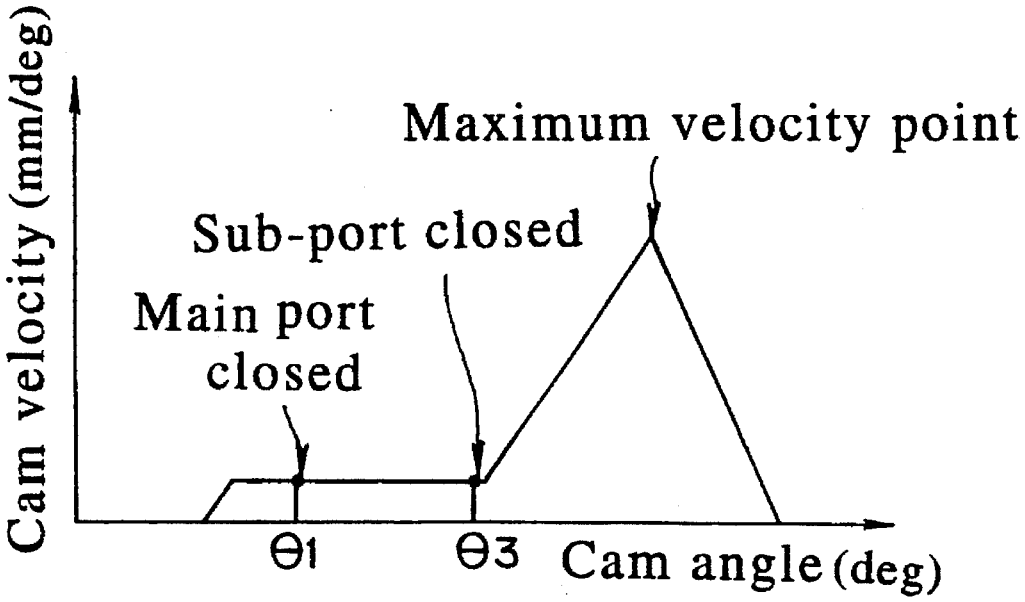
FIG. 39 is a graph showing how cam velocity (corresponding to fuel delivery rate) varies with cam angle in the case of using a cam with another profile.
Figure 40:
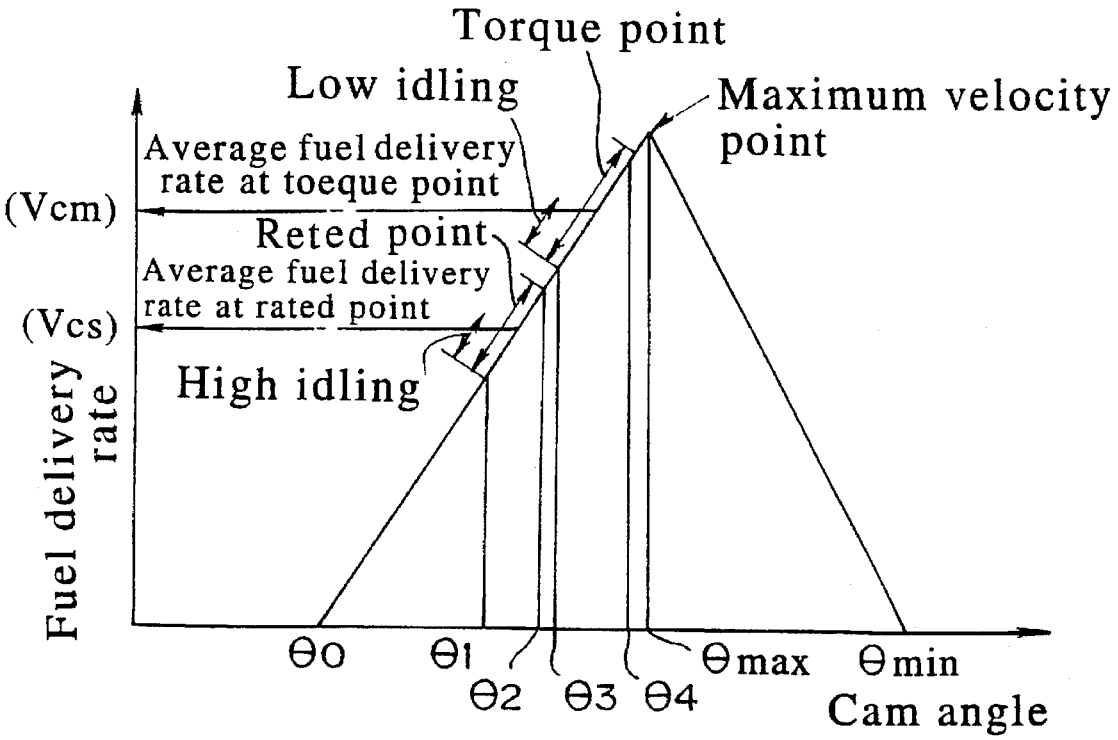
FIG. 40 is a graph showing how fuel delivery rate varies with cam angle for a cam with one profile.
Figure 41:
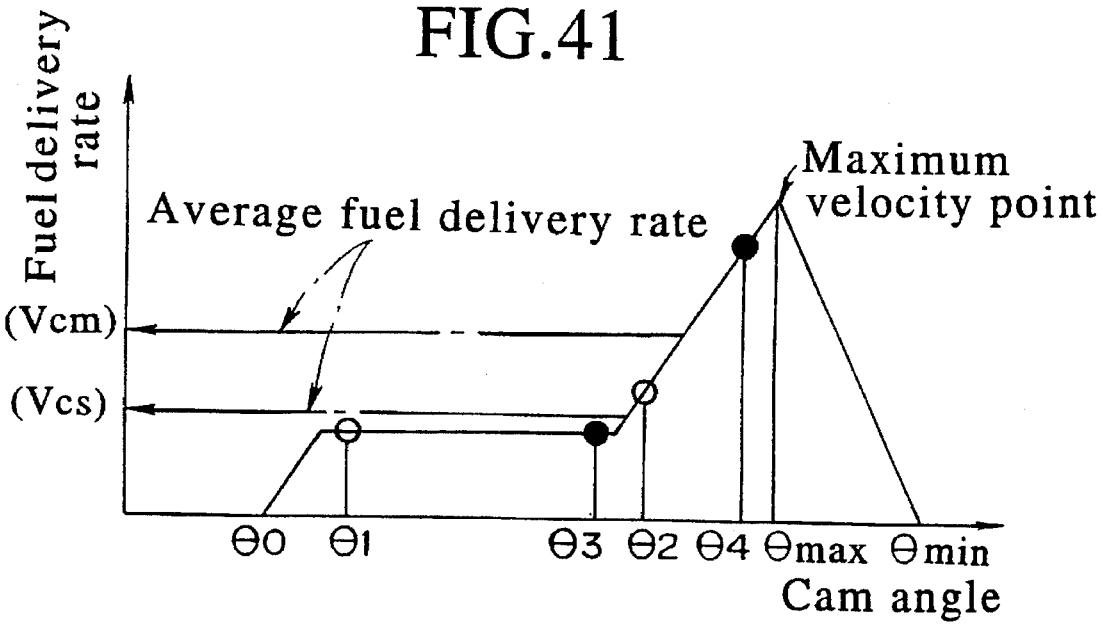
FIG. 41 is a graph showing how fuel delivery rate varies with cam angle for a cam with another profile.
Figure 42:
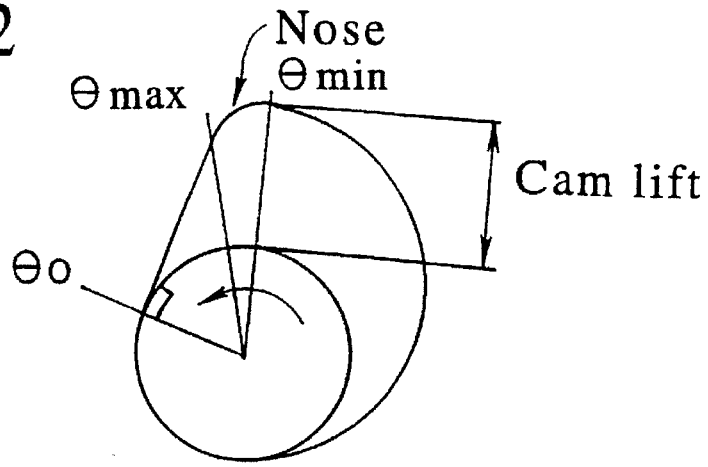
FIG. 42 is a sectional view showing an example profile of a cam corresponding to FIG. 40.
Figure 43:
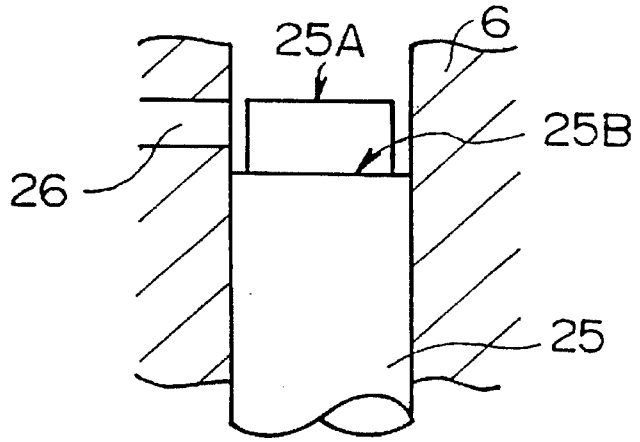
FIG. 43 is a sectional view of an essential portion of a stepped plunger 25 used in another prior art fuel injection pump utilizing the preflow effect.
Figure 44:
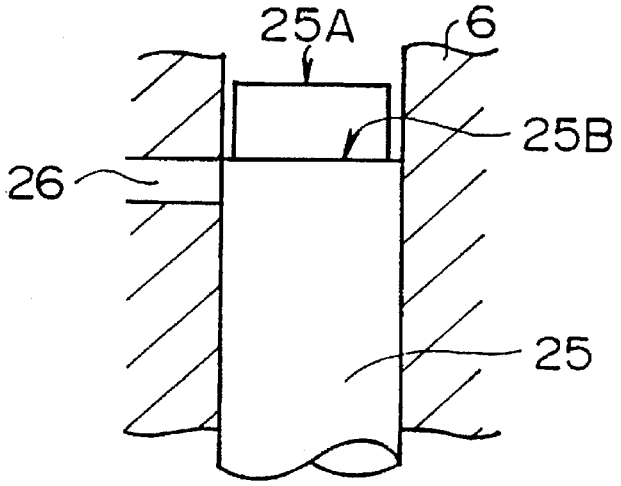
FIG. 44 is a sectional view of an essential portion showing a barrel port 26 closed by the stepped portion 25B of the stepped plunger 25.

FIG. 3 is an enlarged sectional view of an essential portion of a plunger 7 which is a first example of a plunger for use with the first cam (the plunger 7 being substantially the same as that shown in FIG. 36). FIG. 4 is a development of lead grooves at the head portion of a plunger 7, showing the positional relationship between the main port 15 and the sub-port 16 at engine starting (broken lines) and at low-load engine operation and high-load engine operation (chain lines).

As shown by FIGS. 3 and 4, the peripheral surface of the plunger 7 head portion is formed with a vertical passage 18 communicating with the fuel chamber 14, an inclined lead groove 19 communicating with the vertical passage 18, and an upper sub-lead groove 21 communicating with the fuel chamber 14. As shown by the phantom line in FIG. 4, a notch 19A for limiting the quantity of fuel injection during starting can be cut horizontally in the plunger 7 to communicate with the inclined lead groove 19.

The region within which the sub-port 16 is opposite the upper sub-lead groove 21 corresponds to an engine load range extending from low load to high load. The region of the upper sub-lead groove 21 outside this region and the region of the upper end 7A of the plunger 7 outside that within which it is opposite the main port 15 correspond to the engine starting region.

Since the plunger 7 is reciprocated within the plunger barrel 6 by the cam 4, the upper sub-lead groove 21, the vertical passage 18, the inclined lead groove 19 the notch 19A for limiting the quantity of fuel injection during starting move vertically together relative to the stationary main port 15 and sub-port 16. This is shown in FIG. 4.

As also shown in FIG. 4, since the plunger 7 is rotated relative to the plunger barrel 6 by the action of the control rack 5, the upper sub-lead groove 21, the vertical passage 18, the inclined lead groove 19 and the notch 19A for limiting the quantity of fuel injection during starting move laterally together relative to the stationary main port 15 and sub-port 16.

Figure 35:
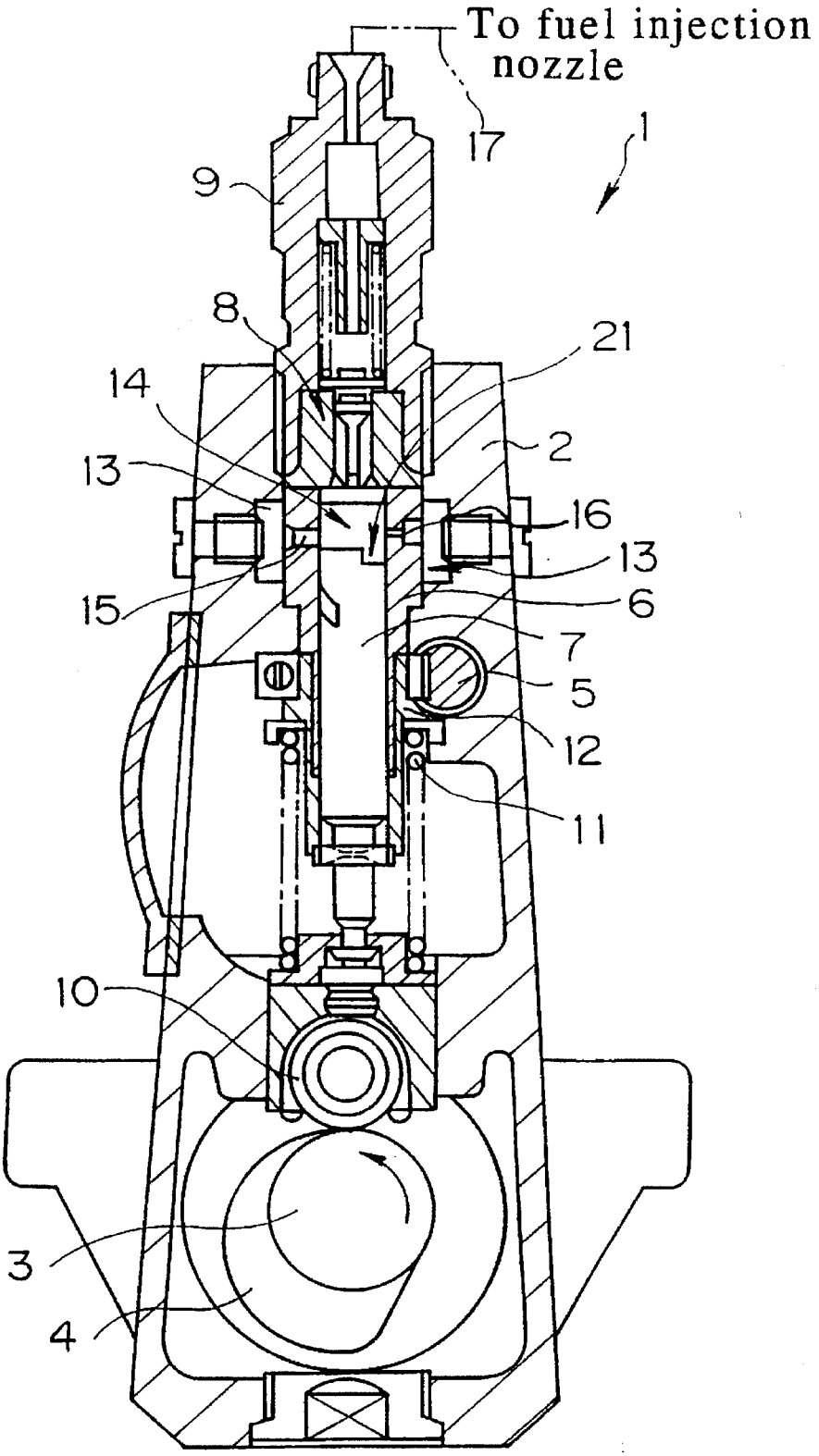
FIG. 35 is a vertical sectional view of a prior art fuel injection pump 1.

The so-configured fuel injection pump operates similarly to the fuel injection pump 1 explained with reference to FIG. 35 in the point that fuel is drawn into the fuel chamber 14 from the fuel reservoir 13 through the main port 15 and the sub-port 16 as the plunger 7 moves down.

As the plunger 7 rises, fuel pressurization starts from the point that the upper end 7A of the plunger 7 and the upper edge 21A of the upper sub-lead groove 21 close the main port 15 and the sub-port 16 and the delivery of pressurized fuel ends when the main port 15 is opened by the inclined lead groove 19 or the notch 19A for limiting the quantity of fuel injection during starting.

More specifically, during engine starting neither the main port 15 nor the sub-port 16 is situated opposite the upper sub-lead groove 21; both face the upper end 7A in the engine starting region of the plunger 7.

Since the effective stroke for delivery of pressurized fuel is therefore maximum, the quantity of fuel injection required for starting the engine can be secured.

Since the upper sub-lead groove 21 is formed such that the upper end 7A of the plunger 7 is located above the upper edge 21A of the upper sub-lead groove 21, fuel injection is more advanced during engine starting than during low-speed/low-load engine operation.

During low-load and high-load engine operation, the main port 15 can be brought opposite the upper end 7A of the plunger 7 and the sub-port 16 can be brought opposite the upper sub-lead groove 21.

During idling or other such low-speed, low-load engine operation, the sub-port 16 is in communication with the upper sub-lead groove 21 so that substantial delivery of pressurized fuel starts from the closure of the sub-port 16 by the upper edge 21A of the upper sub-lead groove 21 and the delivery of pressurized fuel ends when the main port 15 is opened by the inclined lead groove 19.

As the engine speed increases and a high-speed operating engine condition arises, the throttling effect of the sub-port 16 causes fuel delivery to start before the sub-port 16 is completely closed by the upper edge 21A of the upper sub-lead groove 21. As a result, fuel injection is advanced and the delivery stroke becomes longer than during low-speed engine operation.

Figure 5:
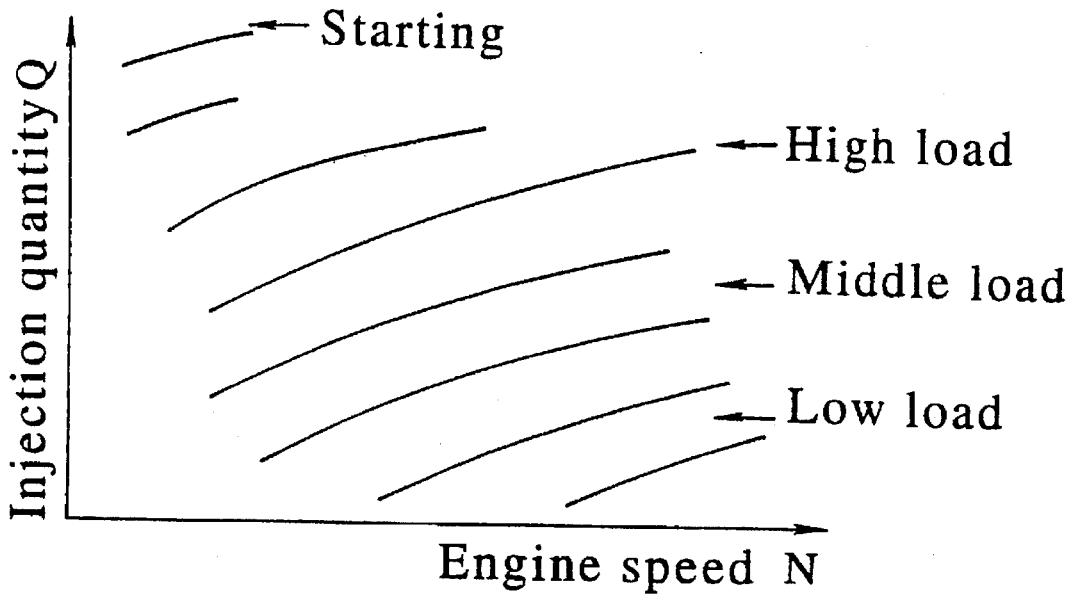
FIG. 5 is an N-Q characteristic diagram showing how fuel injection quantity varies with engine speed.

FIG. 5 is an N-Q characteristic diagram showing how fuel injection quantity varies with engine speed. The characteristics are shown for various load states with the position of the control rack 5 fixed.

As shown, during starting, when the engine speed is low and the quantity of fuel injection large, the quantity of fuel injection increases relative to the movement of the control rack 5.

Figure 6:
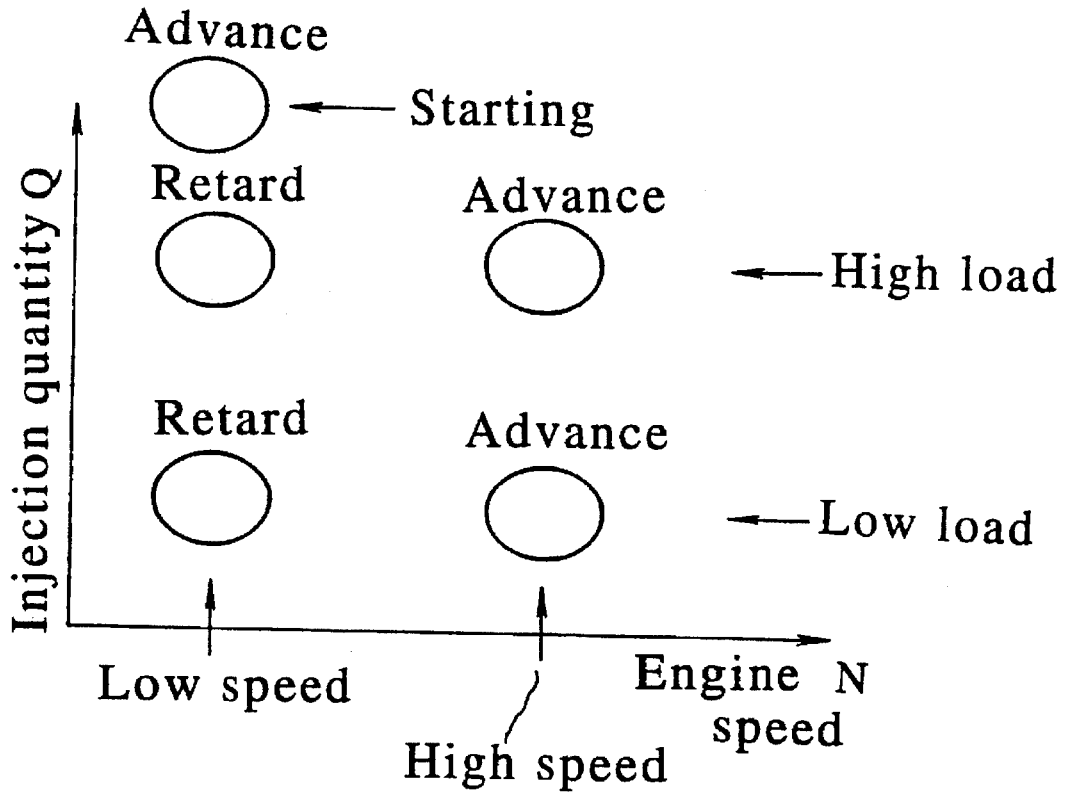
FIG. 6 is a timing map shown within an N-Q characteristic diagram.

FIG. 6 is a timing map shown within an N-Q characteristic diagram. (In the following, the term "advance" will be used to mean "advance of the fuel injection point" and "retard" will be used to mean "retardation of the fuel injection point.")

As shown in this figure, an advance characteristic can be obtained during both engine starting and high-speed operation.

In addition, while the formation of the upper sub-lead groove 21 such that the upper end 7A of the plunger 7 is located above the upper edge 21A enables the quantity of fuel injection to be increased relative to that during high-speed/high-load operation simultaneously with the advance of the injection point at starting, the formation of the notch 19A for limiting the quantity of fuel injection during starting makes it possible to cope with situations in which no increase in fuel injection is required at starting.

Thus, by using a plunger 7 with a sub-port 15 exhibiting preflow effect and forming the upper sub-lead groove 21 at an appropriate position, it is possible to establish fuel injection advance during both high-speed operation and engine starting.

Since the only requirement of the plunger 7 used in the invention fuel injection pump is that it be capable of manifesting the preflow effect, it can be any of various types.

Figure 7:
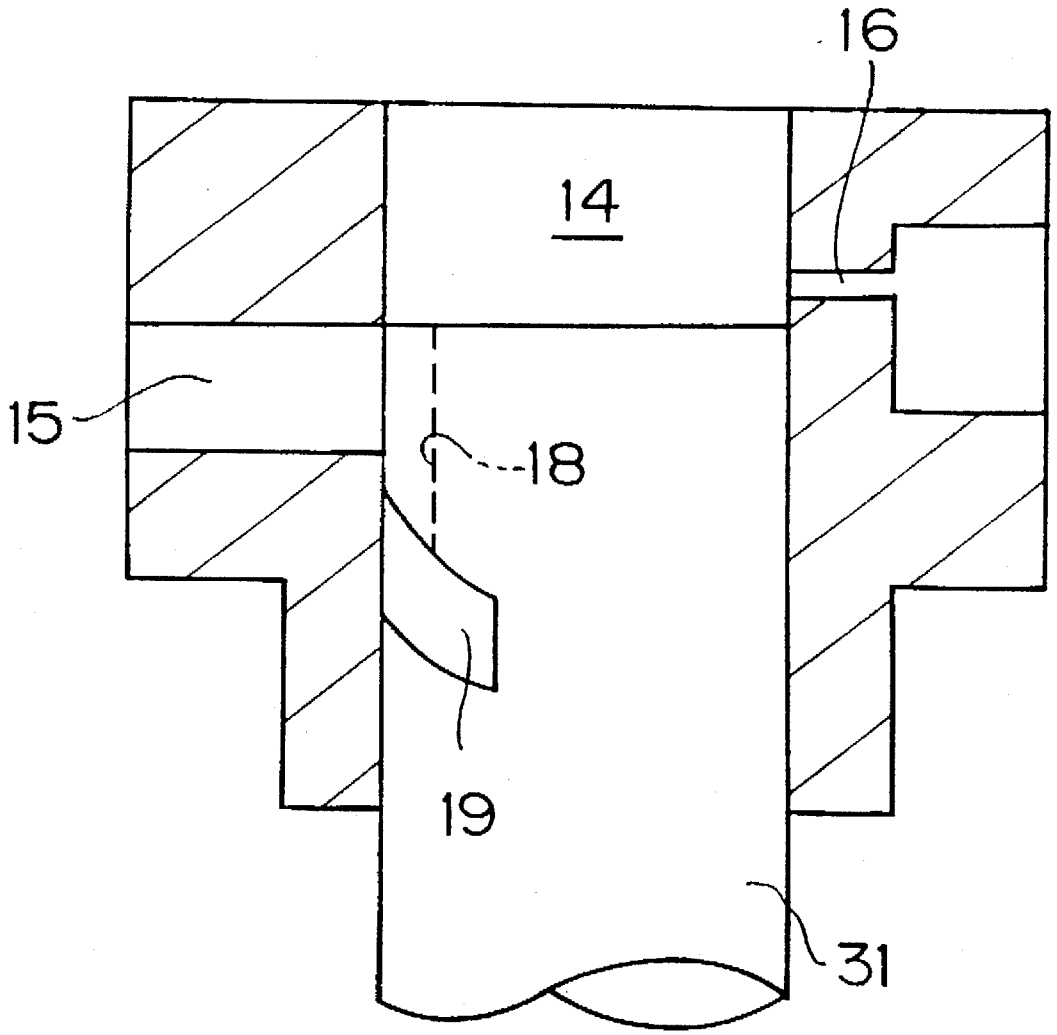
FIG. 7 is a sectional view of another plunger 31 (second example) of the fuel injection pump according to this invention.

FIG. 7 is a sectional view of another plunger 31 (second example) of the fuel injection pump according to this invention. Unlike the plunger 7 of FIG. 3, the plunger 31 is not formed with the upper sub-lead groove 21 and its upper end is left flat.

Since the sub-port 16 is formed above the upper edge 15A of the main port 15 as seen in the drawing, the preflow effect can be obtained during high-speed engine operation, while during low-speed engine operation the delivery of pressurized fuel starts from the time that the this upwardly located sub-port 16 is closed by the plunger 31.

As a result, the advance characteristic changes only with difference in engine speed and there is no difference in advance between starting, low-load engine operation and high-load engine operation.

Figure 8:
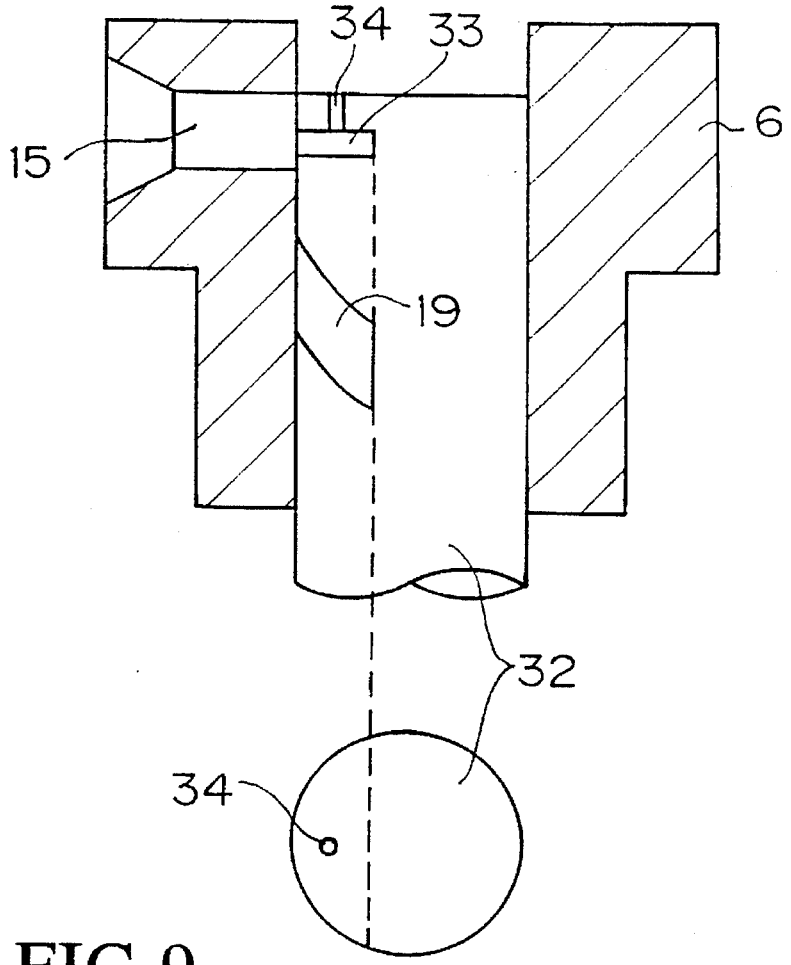
FIG. 8 is a sectional view of another plunger 32 (third example) of the fuel injection pump according to this invention.

FIG. 8 is a sectional view of another plunger 32 (third example) of the fuel injection pump according to this invention. In the plunger 32, the sub-port 16 formed in the plunger barrel 6 in association with the main port 15 in the earlier embodiments is not formed and the plunger 32 is instead formed with a sub-port 33.

Figure 9:
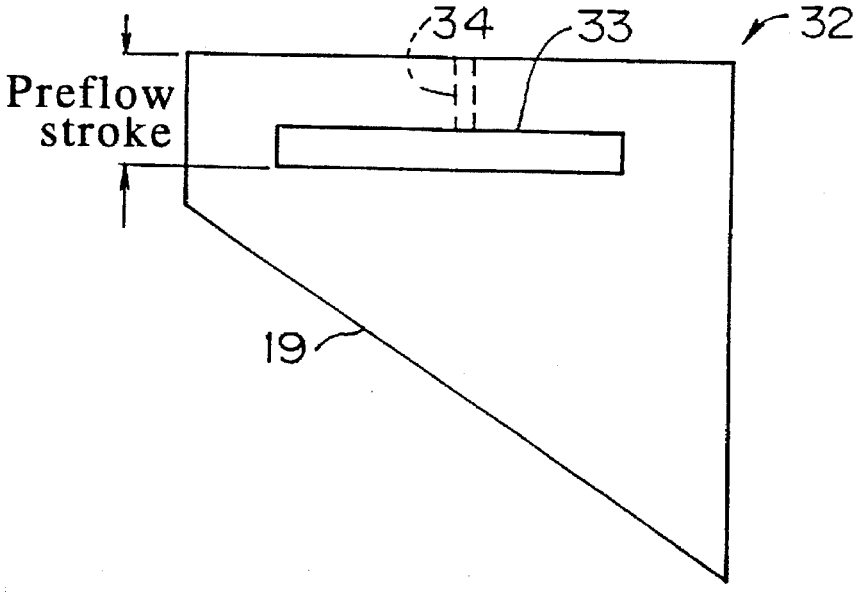
FIG. 9 is a development of the plunger 32.

More specifically, as shown in the development of FIG. 9, the sub-port 33 is formed by cutting a groove into the plunger 32 over a prescribed angle of circumference thereof, to a width that falls within the range of opening of the main port 15 in the axial direction of the plunger 32 and at a position where it can communicate with the main port 15.

The plunger 32 is further formed with an orifice 34 for communicating the sub-port 33 with the fuel chamber 14.

When the plunger 32 is employed, the delivery of pressurized fuel during high-speed engine operation starts at the time that main port 15 is closed by the upper edge of the plunger 32, as shown in FIG. 8, and starts during low-speed engine operation at the time that lower edge of the sub-port 33, which ascends together with the plunger 32, closes the main port 15.

The plunger 32 configured in this manner provides substantially the same fuel injection characteristic as the plunger 31 of FIG. 7 without need to form a sub-port in the plunger barrel 6, thus enabling use of a conventional plunger barrel.

Figure 10:
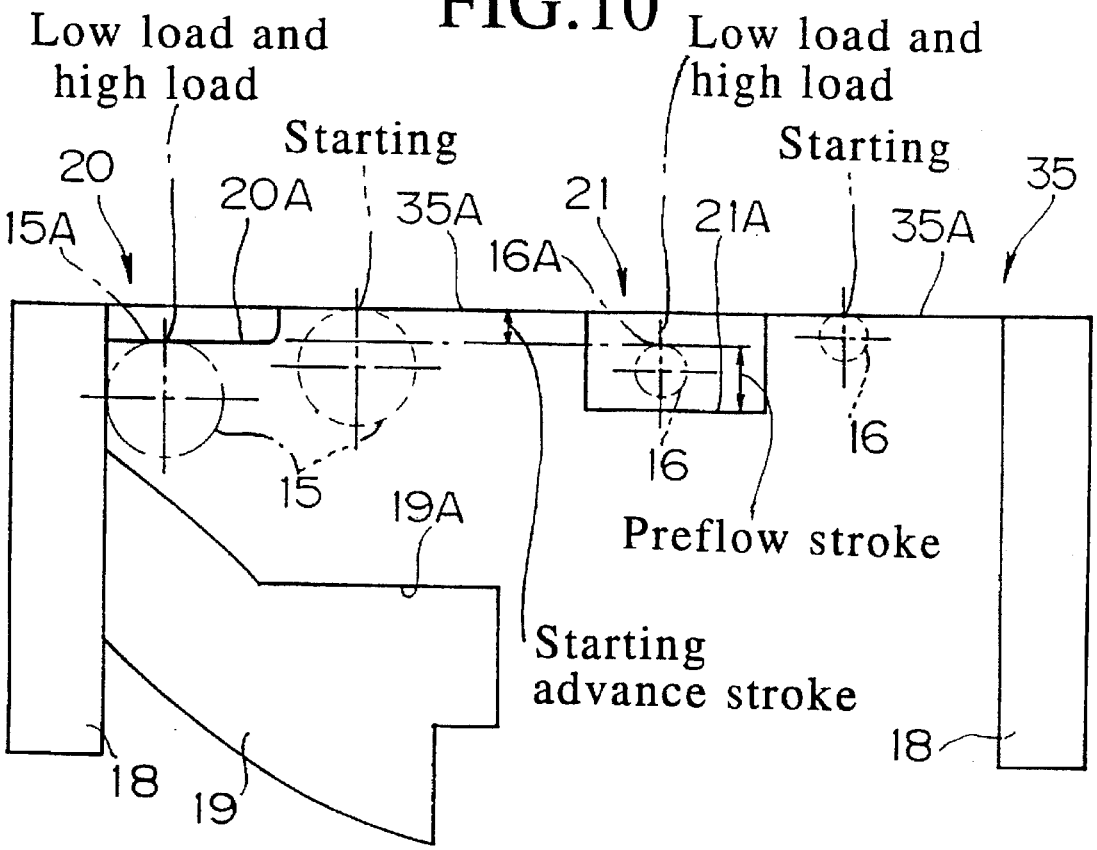
FIG. 10 is a development of lead grooves of another plunger 35 (fourth example) of the fuel injection pump according to this invention.

FIG. 10 is a development of lead grooves of another plunger 35 (fourth example) of the fuel injection pump according to this invention, showing the positional relationship between the main port 15 and the sub-port 16 at engine starting (broken lines) and at low-load engine operation and high-load engine operation (chain lines).

The plunger 35 is configured similarly to the plunger 7 of FIG. 4 but the peripheral surface of its head portion is additional provided with an upper main lead groove 20 that communicates with the fuel chamber 14.

The region of the upper main lead groove 20 and the upper sub-lead groove 21 corresponds to an engine load range extending from low load to high load. The region of the upper end 35A of the plunger 35 corresponds to the engine starting region.

In this configuration, similarly to in the case of the plunger 7 of FIG. 4, as the plunger 35 rises, fuel pressurization starts from the point that the upper end 35A of the plunger 35, the upper edge 20A of the upper main lead groove 20 and the upper edge 21A of the upper sub-lead groove 21 close the main port 15 and the sub-port 16 and the delivery of pressurized fuel ends when the main port 15 is opened by the inclined lead groove 19 or the notch 19A for limiting the quantity of fuel injection during starting.

More specifically, during engine starting neither the main port 15 nor the sub-port 16 is situated opposite the upper main lead groove 20 or the upper sub-lead groove 21; both face the upper end 35A of the plunger 35.

Since the effective stroke for delivery of pressurized fuel is therefore maximum, the quantity of fuel injection required for starting the engine can be secured.

Since the upper main lead groove 20 is formed such that the upper end 35A of the plunger 35 is located above the upper edge 20A of the upper main lead groove 20, fuel injection is more advanced during engine starting than during rated high-load operation.

During low-load and high-load engine operation, the main port 15 can be brought opposite the upper main lead groove 20 and the sub-port 16 can be brought opposite the upper sub-lead groove 21.

During idling or other such low-speed operation, since the sub-port 16 is in communication with the upper sub-lead groove 21, substantial delivery of pressurized fuel starts from the closure of the sub-port 16 by the upper edge 21A of the upper sub-lead groove 21 and ends when the main port 15 is opened by the inclined lead groove 19.

As the engine speed increases and a high-speed engine operating condition arises, the throttling effect of the sub-port 16 causes fuel delivery to start before the sub-port 16 is completely closed by the upper edge 21A of the upper sub-lead groove 21. As a result, fuel injection is advanced and the delivery stroke becomes longer than during low-speed engine operation.

The N-Q characteristic indicating the relationship between the engine speed and the quantity of fuel injection is therefore substantially the same as that shown in FIG. 5, and the quantity of fuel injection increases relative to the movement of the control rack 5 during the low-speed/high-load operating condition at starting.

Figure 11:
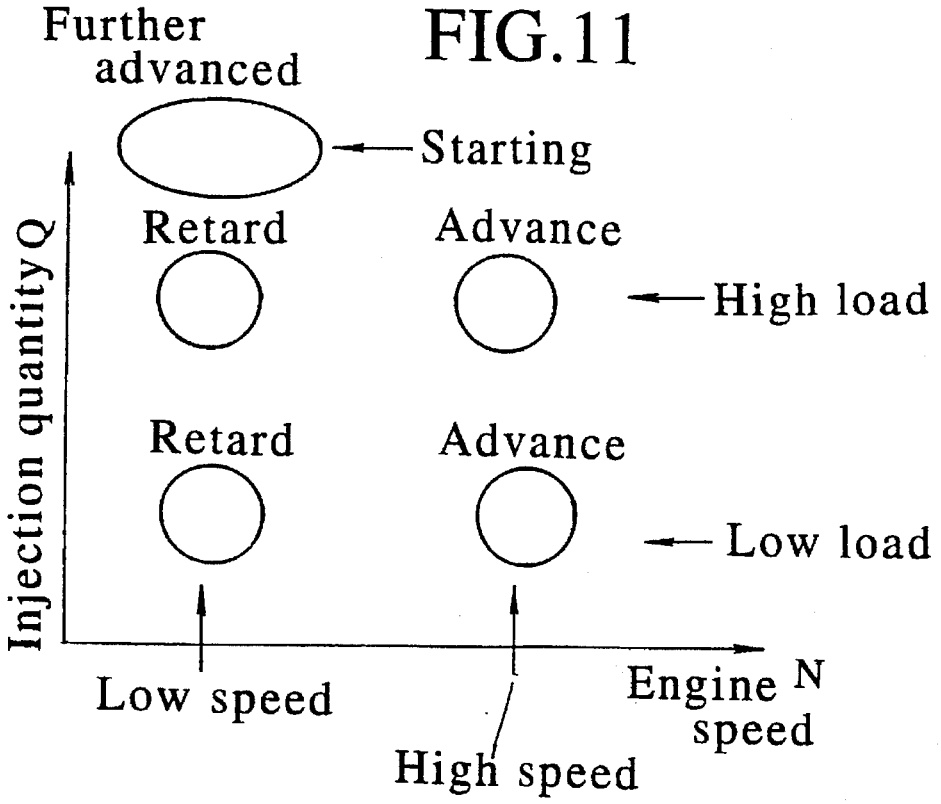
FIG. 11 is a timing map, similar to that of FIG. 6, shown within an N-Q characteristic diagram.

FIG. 11 is a timing map, similar to that of FIG. 6, shown within an N-Q characteristic diagram, from which it will be noted that an advance characteristic can be obtained during both engine starting and high-speed operation.

Figure 12:
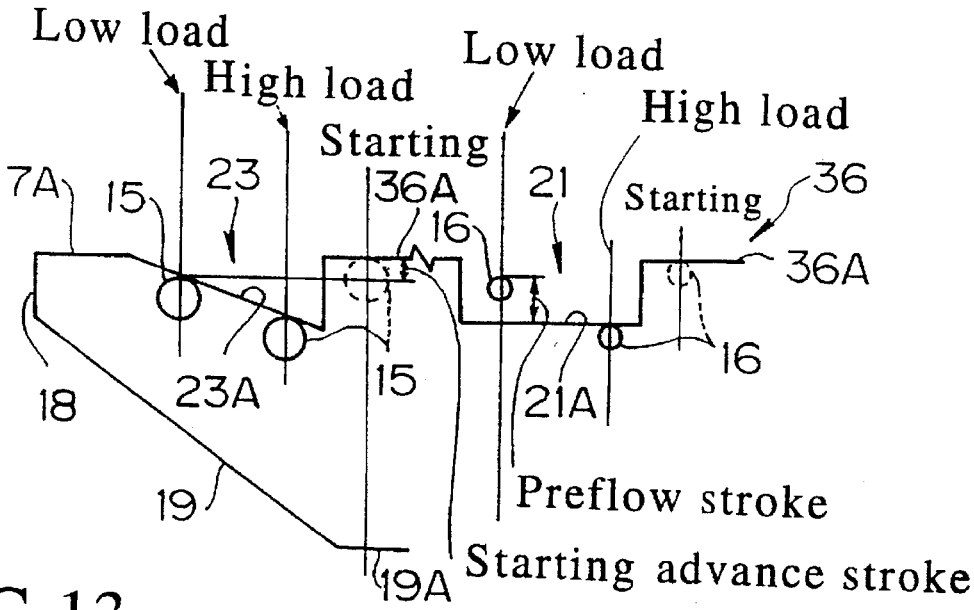
FIG. 12 is a development of lead grooves of another plunger 36 (fifth example) of the fuel injection pump according to this invention.

FIG. 12 is a development of lead grooves of another plunger 36 (fifth example) of the fuel injection pump according to this invention. While the plunger 36 has substantially the same configuration as the plunger 35 of FIG. 10 on the side of the sub-port 16, it is further formed with an inclined upper main lead groove 23 for communicating with the main port 15 during low-load engine operation and high-load engine operation.

The upper main lead groove 23 has an inclined upper edge 23A which slopes downward from low load toward high load.

Figure 13:
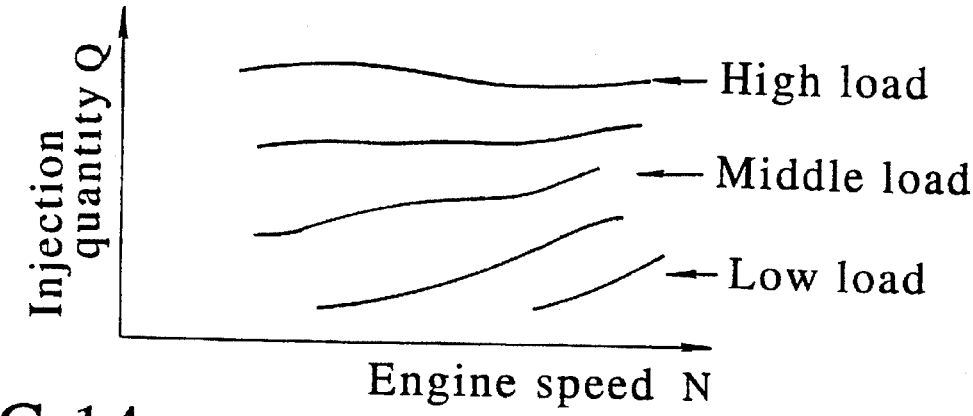
FIG. 13 is an N-Q characteristic diagram showing how fuel injection quantity varies with engine speed.

Since this configuration results in a longer effective stroke during high-load engine operation than during low-load engine operation, it ensures increased fuel injection even during low-speed engine operation. Therefore, as shown in FIG. 13, it is possible to achieve an N-Q characteristic at high load comparable to that of an ordinary fuel injection pump.

Figure 14:
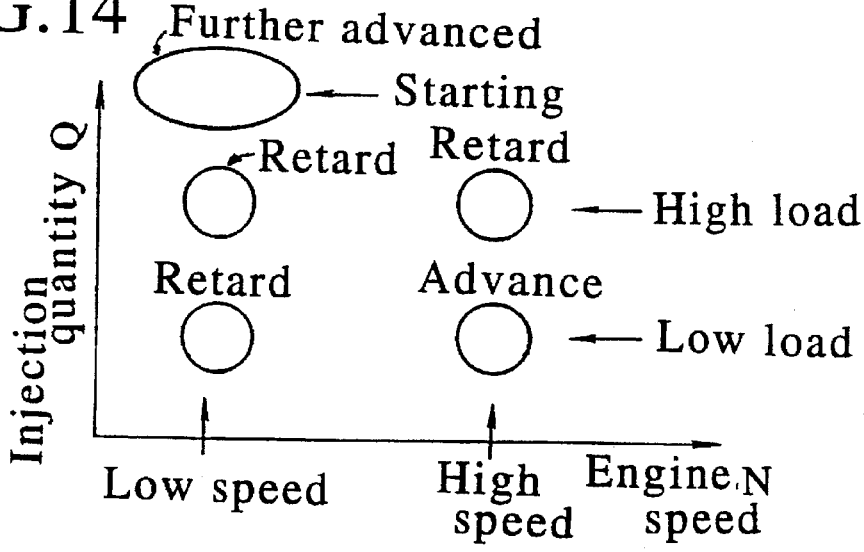
FIG. 14 is a timing map shown within an N-Q characteristic diagram.

Similarly to during high-load engine operation, some degree of improvement in the quantity of fuel injection is also obtained during middle-load operation. During low-load engine operation, however, the main port 15 is positioned above the upper sub-lead groove 21 even after the main port 15 aligns with the inclined upper edge 23A and, therefore, as shown in the timing map of FIG. 14, the advance by the preflow effect is lost at high load, the prestroke becomes maximum on the low-load side, the maximum advance is obtained during high-speed/low-load engine operation, and, as in the case of a fuel injection pump having a plunger with preflow effect, the fuel injection point can be advanced only during low-load engine operation.

During starting, since the main port 15 and the sub-port 16 are closed by the upper end 7A of the plunger 7, the advance is even greater than during low-load engine operation or high-load engine operation.

It thus becomes possible to reduce idling noise caused by the preflow effect and to prevent misfire and generation of bluish white smoke during high idling, as well as to obtain appropriate torque (improve low-speed torque) owing to a flattening of the N-Q characteristic curve at high load.

When an inclined upper main lead groove 23 is formed, the fuel injection point advance angle can be controlled over the low-load to high-load range and the low-speed to high-speed range by adjusting the amount and direction of inclination of the upper main lead groove 23.

The plunger used in this invention can be one whose head portion has been formed with any of various stepped configurations for obtaining the preflow effect. Several examples are set out below.

Figure 15:
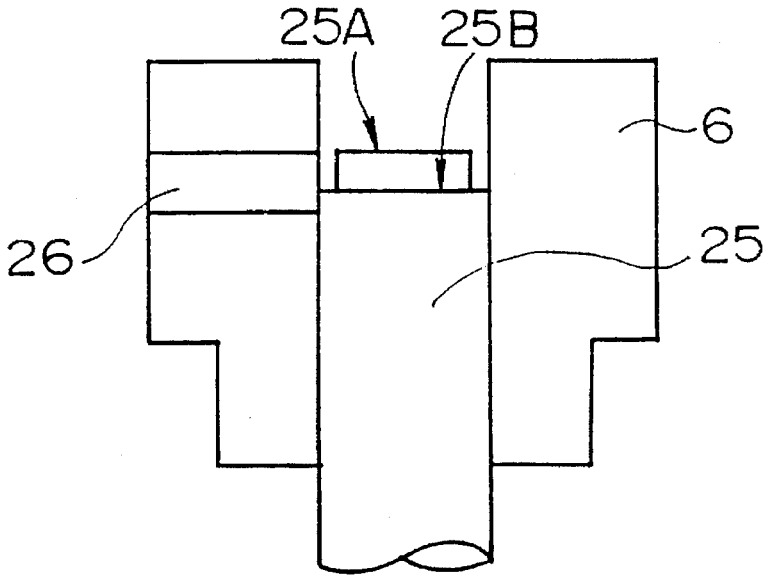
FIG. 15 is a sectional view of another plunger 25 (sixth example) of the fuel injection pump according to this invention.

FIG. 15 is a sectional view of another plunger 25 (sixth example) of the fuel injection pump according to this invention. The stepped plunger 25 is formed with an upper end 25A and a stepped portion 25B, similarly to what was explained earlier regarding FIG. 43.

Figure 16:
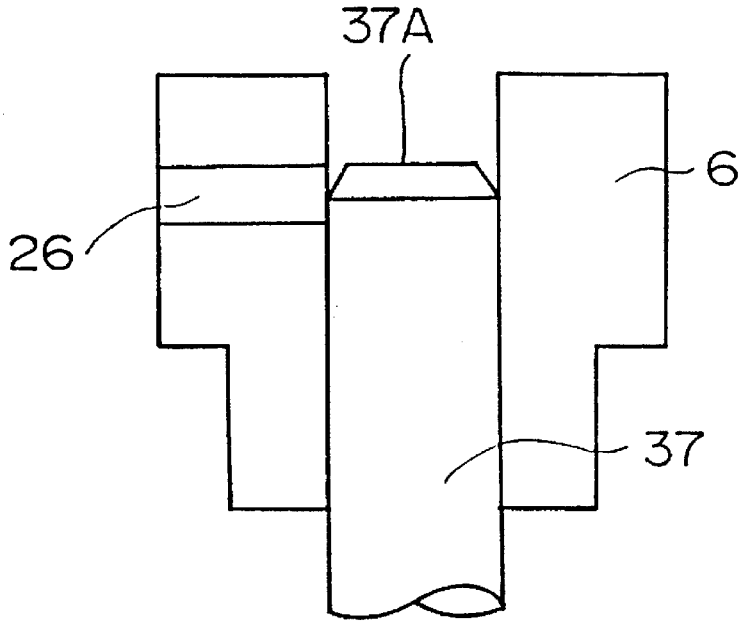
FIG. 16 is a sectional view of another plunger 37 (seventh example) of the fuel injection pump according to this invention.

FIG. 16 is a sectional view of another plunger 37 (seventh example) of the fuel injection pump according to this invention. The head portion of the plunger 37 is formed with a trapezoidal stepped portion 37A having the sectional shape of a trapezoid.

Figure 17:
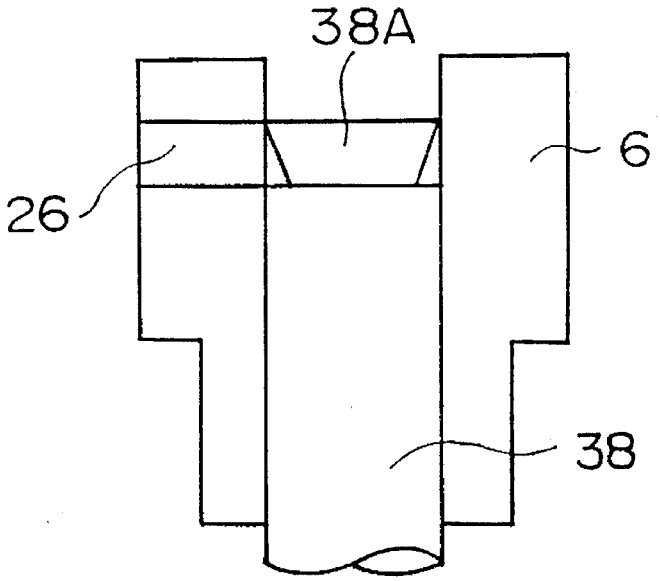
FIG. 17 is a sectional view of another plunger 38 (eighth example) of the fuel injection pump according to this invention.

FIG. 17 is a sectional view of another plunger 38 (eighth example) of the fuel injection pump according to this invention. The head portion of the plunger 38 is formed with an inverted trapezoidal stepped portion 38A having the sectional shape of an inverted trapezoid.

Figure 18:
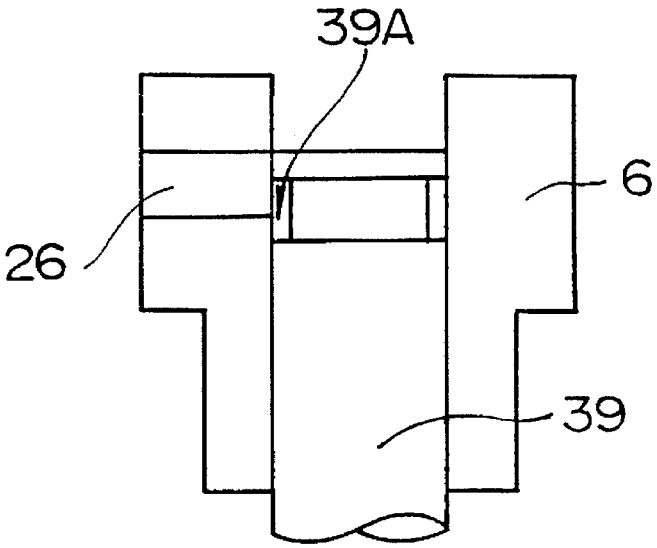
FIG. 18 is a sectional view of another plunger 39 (ninth example) of the fuel injection pump according to this invention FIG.

FIG. 18 is a sectional view of another plunger 39 (ninth example) of the fuel injection pump according to this invention. The head of the plunger 39 is formed with an annular groove 39A.

Examples of cam profiles used in the invention will now be explained with reference to FIGS. 19 to 34.

Figure 19:
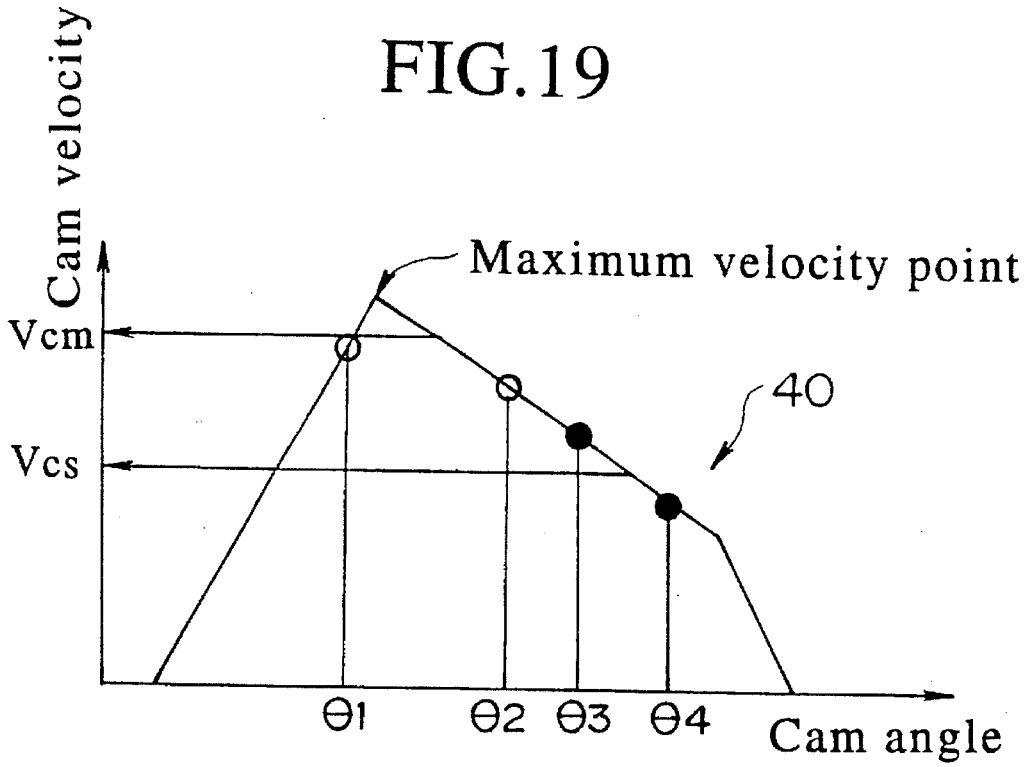
FIG. 19 is a graph showing how cam velocity varies with cam angle for a cam of profile 40 (second example).

FIG. 19 is a graph showing how cam velocity varies with cam angle for a cam of profile 40 (second example). As can be seen from this graph, the cam angle θ1 at which delivery of pressurized fuel starts during high-speed engine operation is located before the maximum velocity point, and the cam angle θ2 at which this delivery terminates, the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 20:
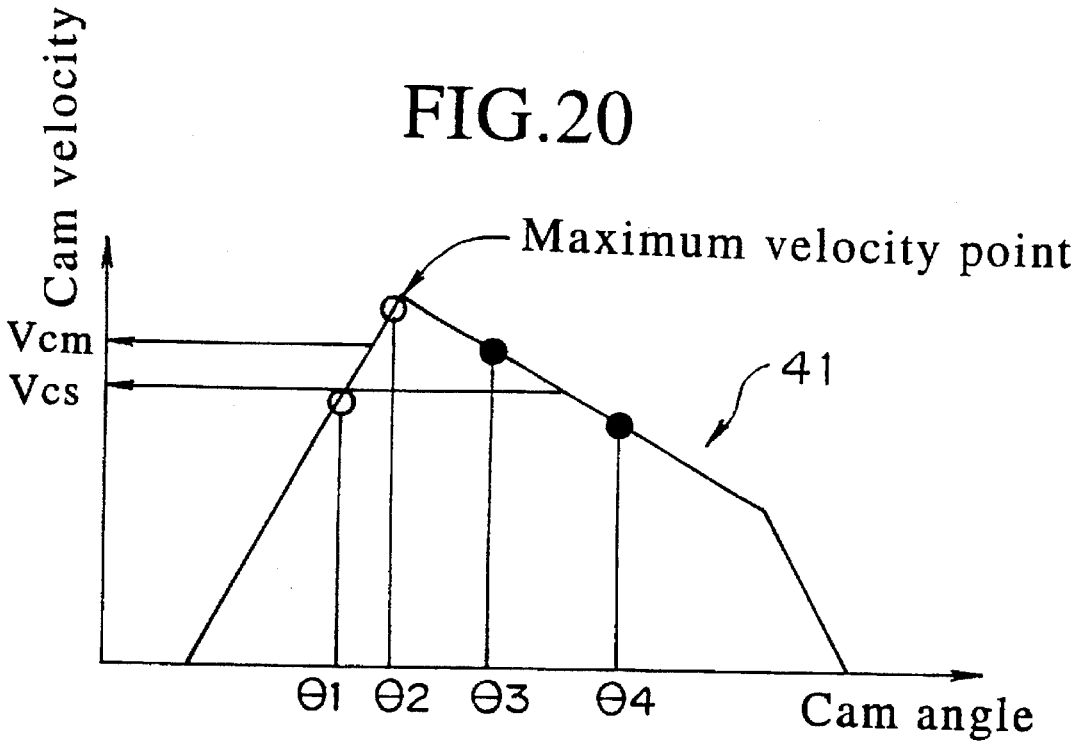
FIG. 20 is a graph showing how cam velocity varies with cam angle for a cam of profile 41 (third example).

FIG. 20 is a graph showing how cam velocity varies with cam angle for a cam of profile 41 (third example). As can be seen from this graph, the cam angle θ1 at which delivery of pressurized fuel starts during high-speed engine operation and the cam angle θ2 at which this delivery terminates are located before the maximum velocity point, and the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 21:
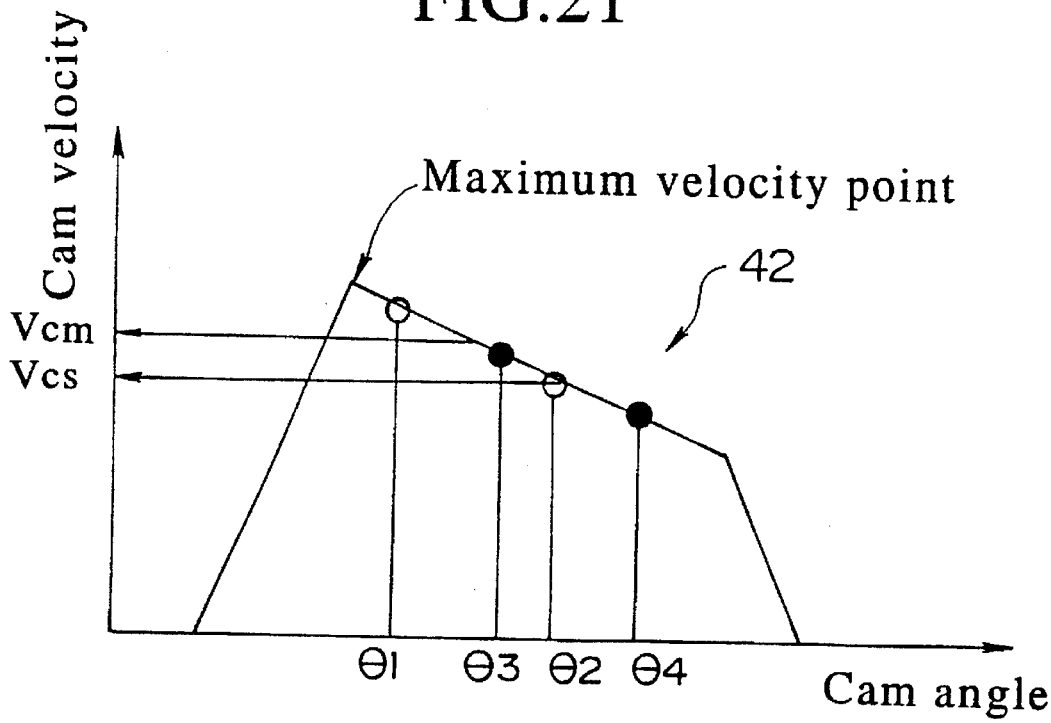
FIG. 21 is a graph showing how cam velocity varies with cam angle for a cam of profile 42 (fourth example).

FIG. 21 is a graph showing how cam velocity varies with cam angle for a cam of profile 42 (fourth example). As can be seen from this graph, the cam angle θ1 at which delivery of pressurized fuel starts during high-speed engine operation, the cam angle θ3 at which delivery starts during low engine speed operation, the cam angle θ2 at which delivery terminates during high-speed engine operation, and the cam angle θ4 at which delivery terminates during low-speed engine operation are located, in the order mentioned, after the maximum velocity point.

As a result, the average cam velocity (fuel delivery rate) during high engine speed operation is greater than the average cam velocity (fuel delivery rate) during low engine speed operation.

Figure 22:
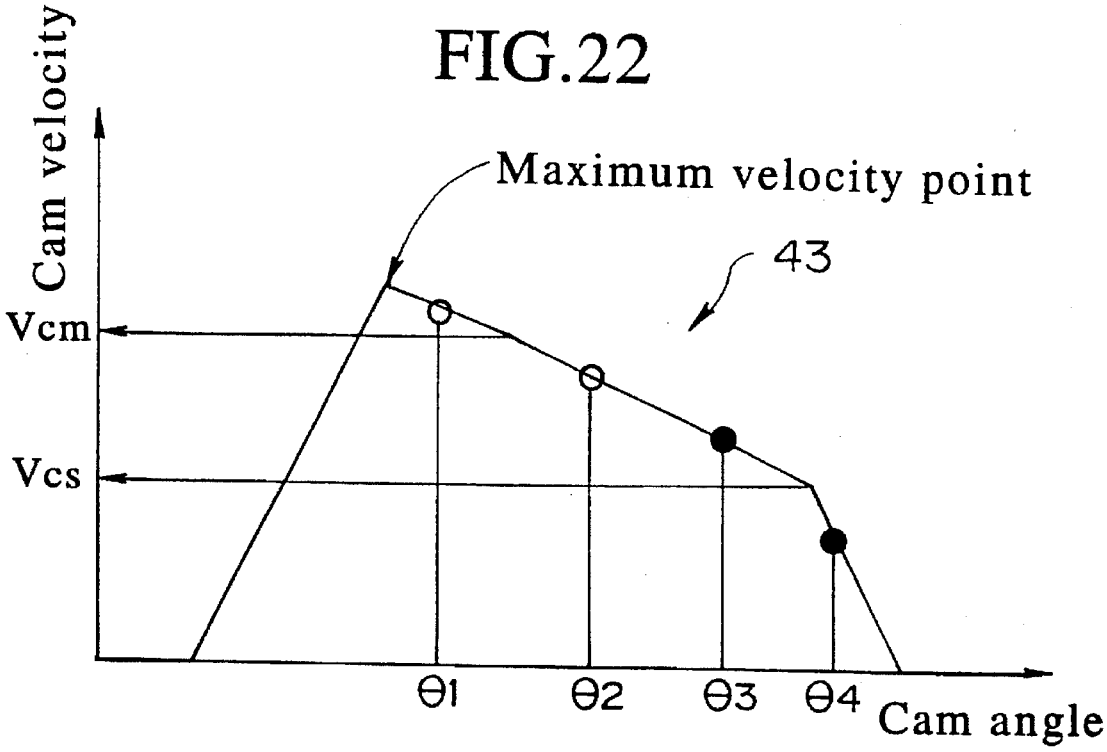
FIG. 22 is a graph showing how cam velocity varies with cam angle for a cam of profile 43 (fifth example).

FIG. 22 is a graph showing how cam velocity varies with cam angle for a cam of profile 43 (fifth example). As can be seen from this graph, the cam angle θ1 at which delivery of pressurized fuel starts during high-speed engine operation, the cam angle θ2 at which this delivery terminates, the cam angle θ3 at which delivery starts during low engine speed operation and the cam angle θ4 at which this delivery terminates are located, in the order mentioned, after the maximum velocity point. The θ4 at which delivery terminates during low-speed engine operation is located at the nose portion at the end of the cam 4.

As a result, the average cam velocity (fuel delivery rate) during high engine speed operation is greater than the average cam velocity (fuel delivery rate) during low engine speed operation.

Figure 23:
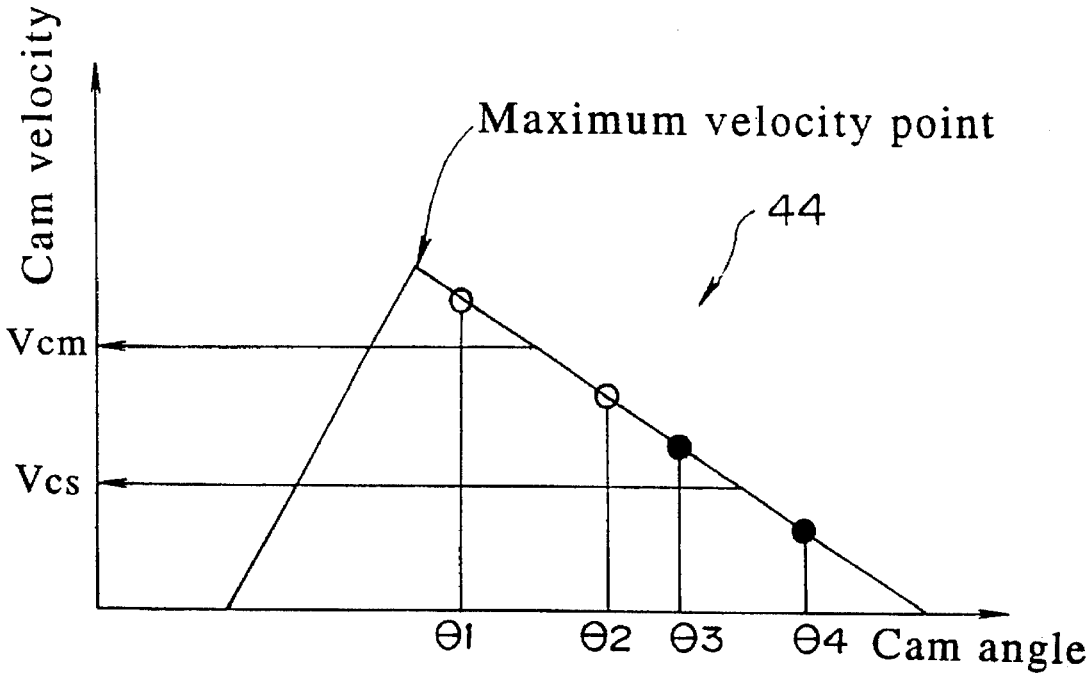
FIG. 23 is a graph showing how cam velocity varies with cam angle for a cam of profile 44 (sixth example).

FIG. 23 is a graph showing how cam velocity varies with cam angle for a noseless cam of profile 44 (sixth example). As can be seen from this graph, the cam angle θ1 at which delivery of pressurized fuel starts during high-speed engine operation, the cam angle θ2 at which this delivery terminates, the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 24:
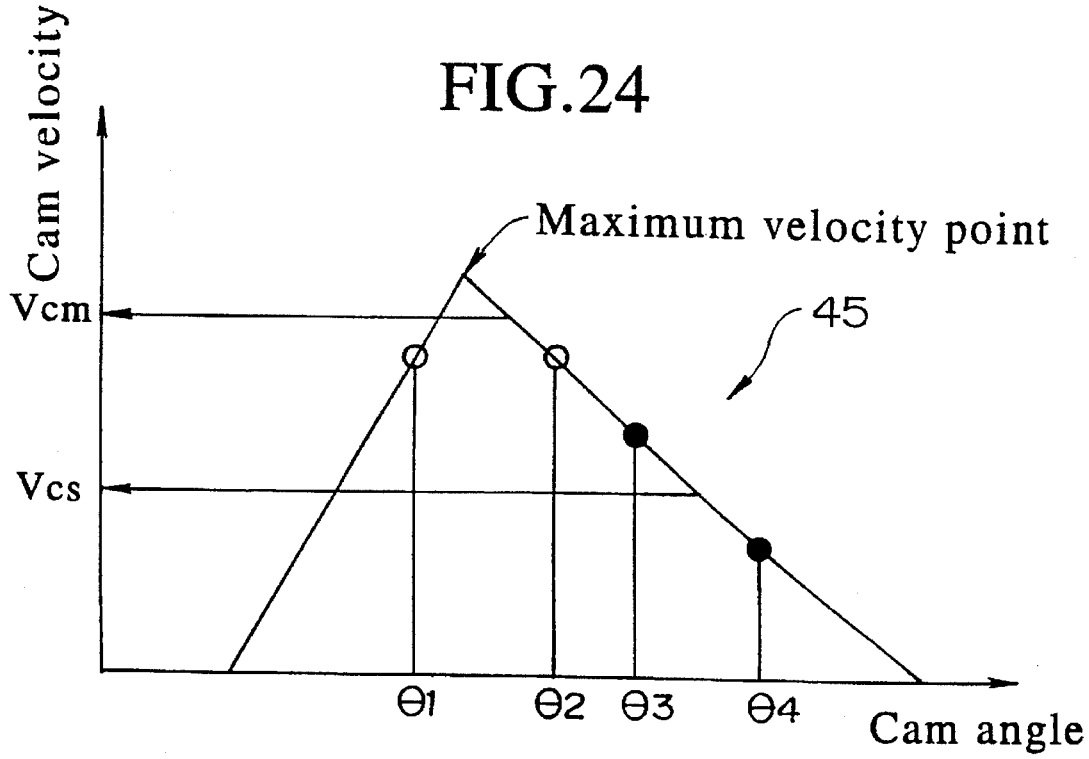
FIG. 24 is a graph showing how cam velocity varies with cam angle for a cam of profile 45 (seventh example).

FIG. 24 is a graph showing how cam velocity varies with cam angle for a cam of profile 45 (seventh example). As can be seen from this graph, the cam angle θ1 at which delivery of pressurized fuel starts during high-speed engine operation is located before the maximum velocity point, and the cam angle θ2 at which this delivery terminates, the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 25:
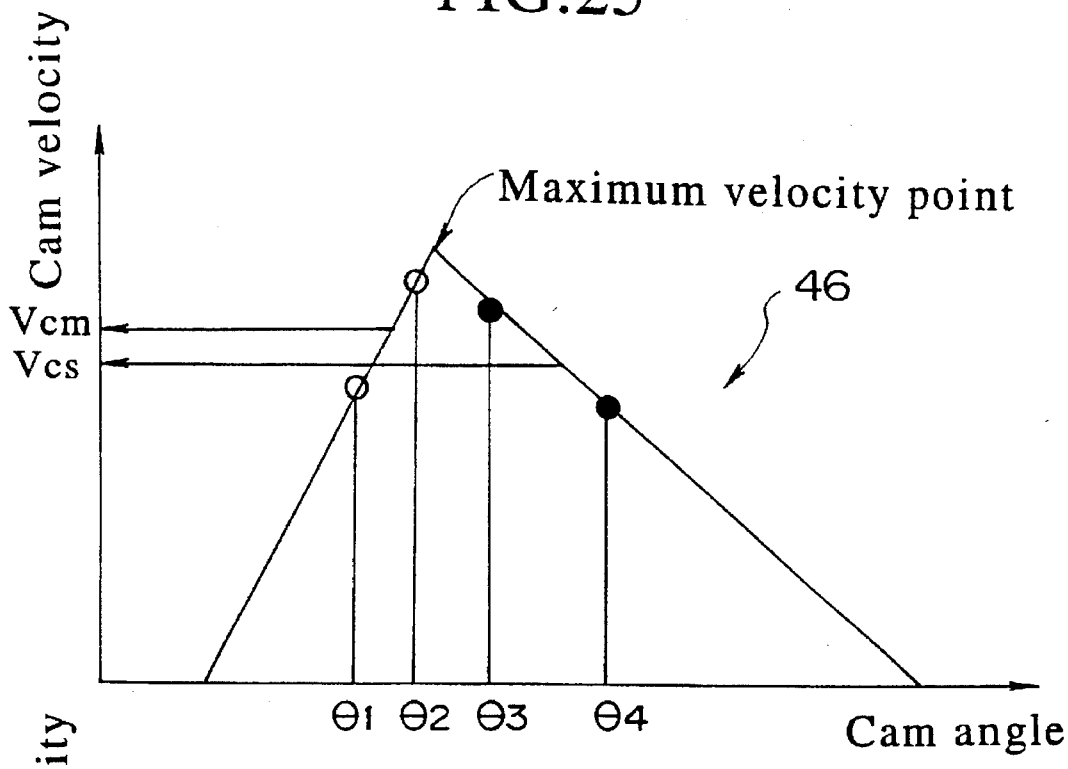
FIG. 25 is a graph showing how cam velocity varies with cam angle for a cam of profile 46 (eighth example).

FIG. 25 is a graph showing how cam velocity varies with cam angle for a cam of profile 46 (eighth example). As can be seen from this graph, the cam angle θ1 at which delivery of pressurized fuel starts during high-speed engine operation and the cam angle θ2 at which this delivery terminates are located before the maximum velocity point, and the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 26:
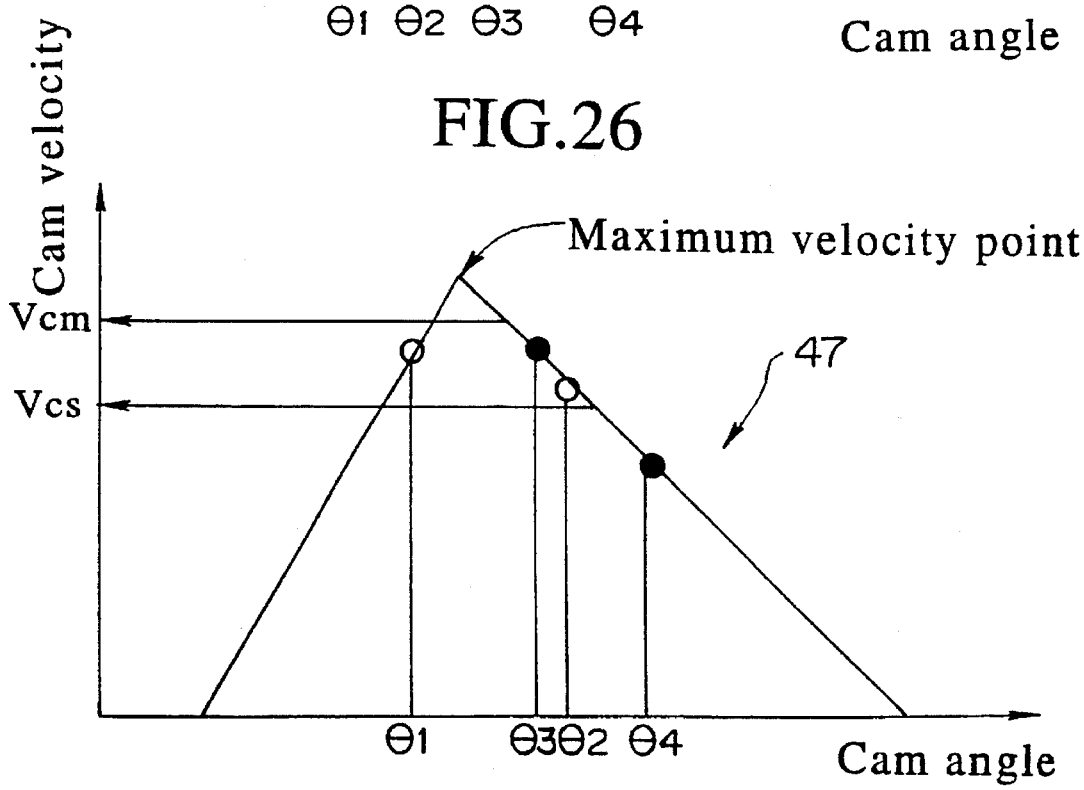
FIG. 26 is a graph showing how cam velocity varies with cam angle for a cam of profile 47 (ninth example).

FIG. 26 is a graph showing how cam velocity varies with cam angle for a cam of profile 47 (ninth example). As can be seen from this graph, the cam angle θ1 at which delivery of pressurized fuel starts during high-speed engine operation is located before the maximum velocity point, and the cam angle θ3 at which delivery starts during low engine speed operation, the cam angle θ2 at which delivery terminates during high-speed engine operation, and the cam angle θ4 at which delivery terminates during low-speed engine operation are located, in the order mentioned, after the maximum velocity point.

As a result, the average cam velocity (fuel delivery rate) during high engine speed operation is greater than the average cam velocity (fuel delivery rate) during low engine speed operation.

Figure 27:
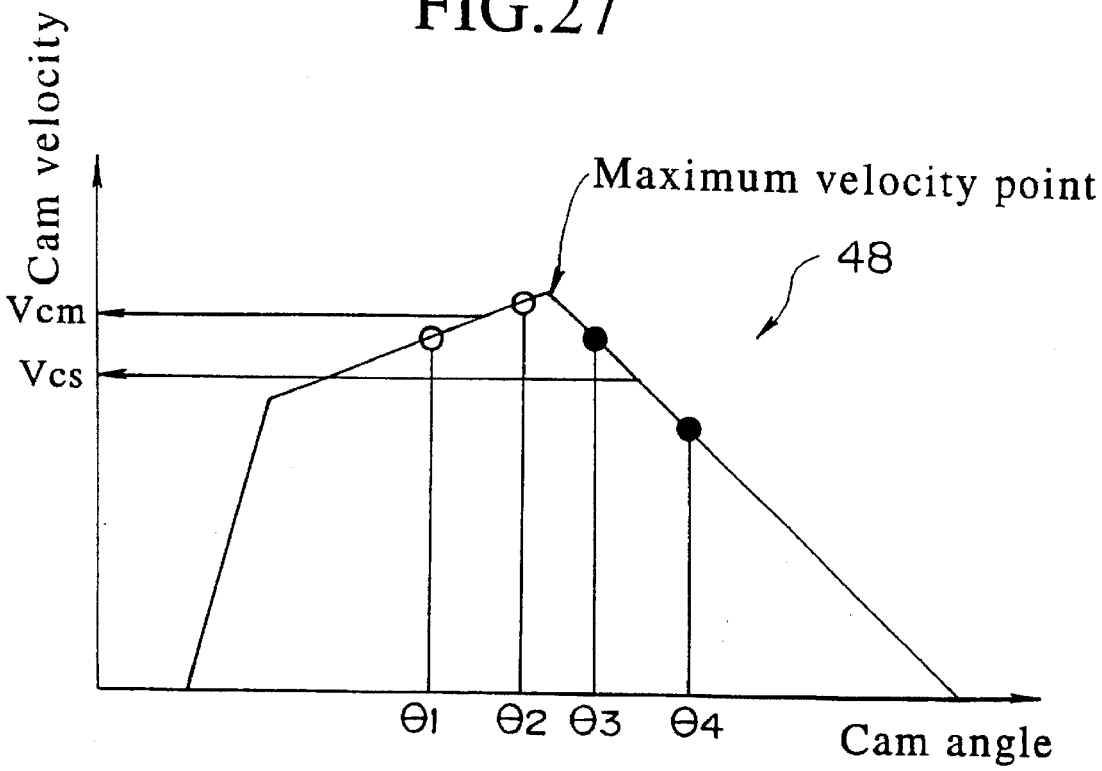
FIG. 27 is a graph showing how cam velocity varies with cam angle for a cam of profile 48 (tenth example).

FIG. 27 is a graph showing how cam velocity varies with cam angle for a cam of profile 48 (tenth example). As can be seen from this graph, the cam angle θ1 at which delivery of pressurized fuel starts during high-speed engine operation and the cam angle θ2 at which this delivery terminates are located before the maximum velocity point, and the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 28:
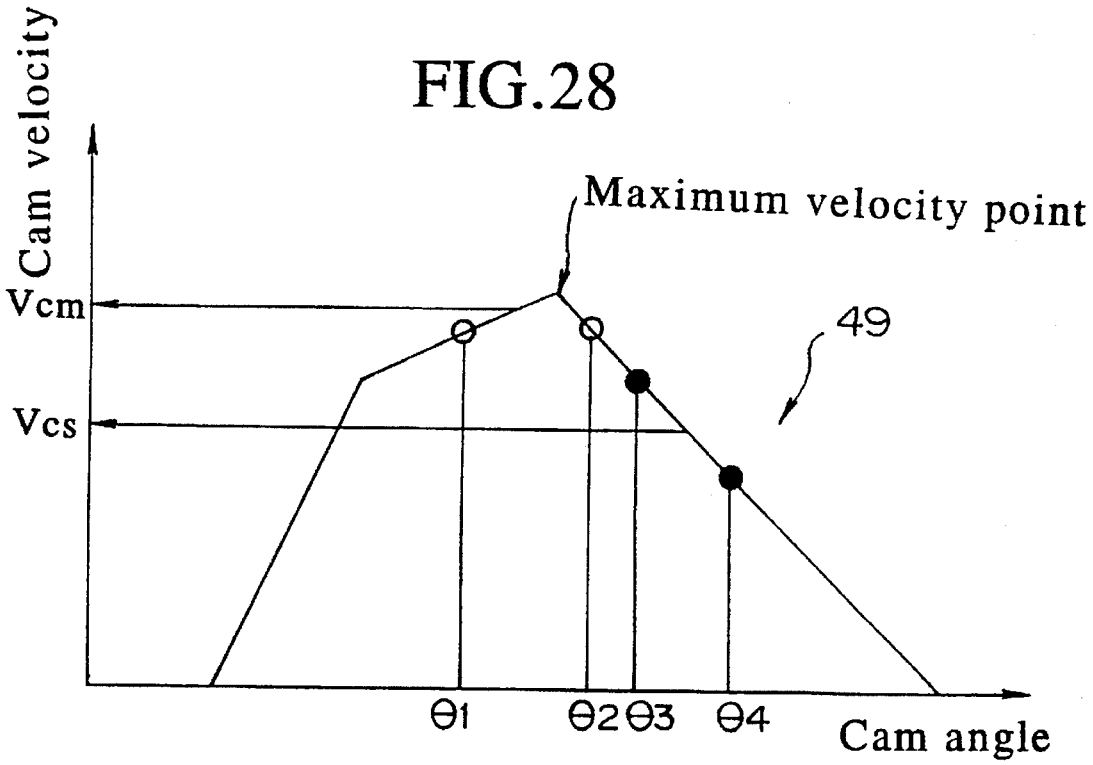
FIG. 28 is a graph showing how cam velocity varies with cam angle for a cam of profile 49 (eleventh example).

FIG. 28 is a graph showing how cam velocity varies with cam angle for a cam of profile 49 (eleventh example). As can be seen from this graph, the cam angle θ1 at which delivery of pressurized fuel starts during high-speed engine operation is located before the maximum velocity point, and the cam angle θ2 at which this delivery terminates, the cam angle θ3 at which delivery starts during low engine speed operation and the cam angle θ4 at which this delivery terminates are located, in the order mentioned, after the maximum velocity point.

As a result, the average cam velocity fuel delivery rate) during high engine speed operation is greater than the average cam velocity (fuel delivery rate) during low engine speed operation.

Figure 29:
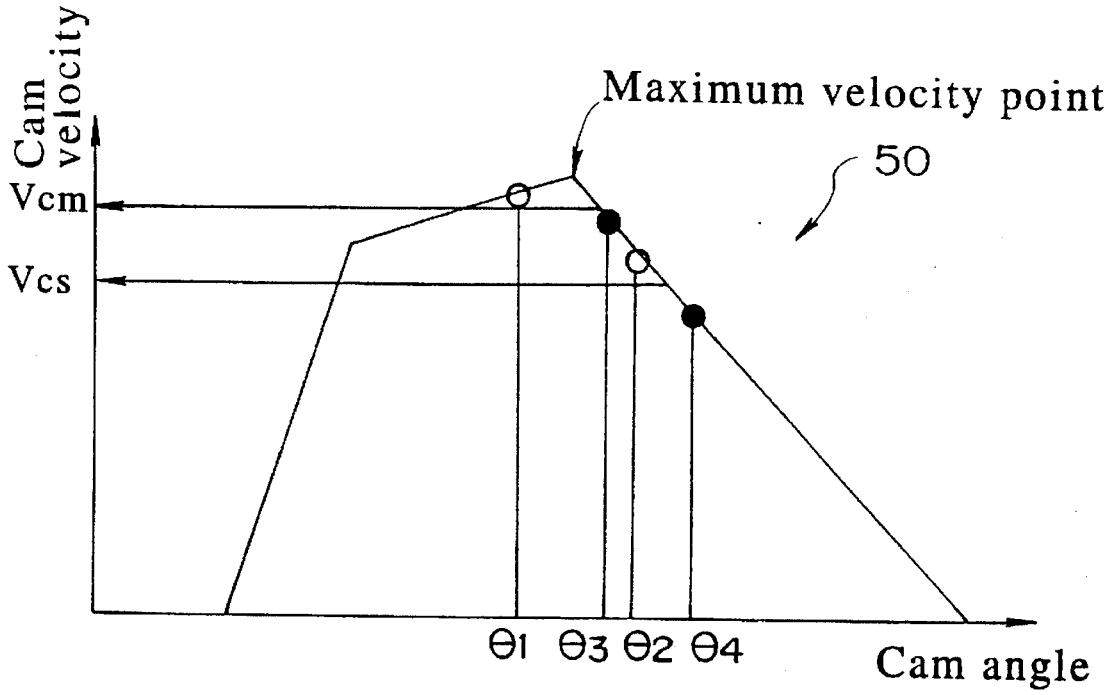
FIG. 29 is a graph showing how cam velocity varies with cam angle for a cam of profile 50 (twelfth example).

FIG. 29 is a graph showing how cam velocity varies with cam angle for a cam of profile 50 (twelfth example). As can be seen from this graph, the cam angle θ1 at which delivery of pressurized fuel starts during high-speed engine operation is located before the maximum velocity point, and the cam angle θ3 at which delivery starts during low engine speed operation, the cam angle θ2 at which delivery terminates during high-speed engine operation, and the cam angle θ4 at which delivery terminates during low-speed engine operation are located, in the order mentioned, after the maximum velocity point.

As a result, the average cam velocity (fuel delivery rate) during high engine speed operation is greater than the average cam velocity (fuel delivery rate) during low engine speed operation.

Figure 30:
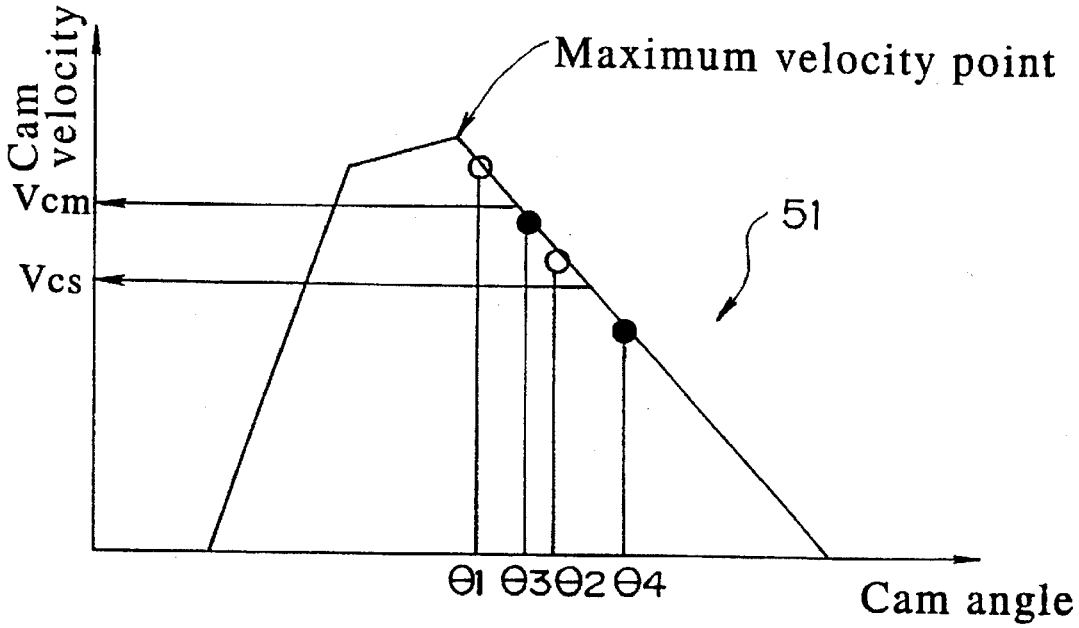
FIG. 30 is a graph showing how cam velocity varies with cam angle for a cam of profile 51 (thirteenth example).

FIG. 30 is a graph showing how cam velocity varies with cam angle for a cam of profile 51 (thirteenth example). As can be seen from this graph, the cam angle θ1 at which delivery of pressurized fuel starts during high-speed engine operation, the cam angle θ3 at which delivery starts during low engine speed operation, the cam angle θ2 at which delivery terminates during high-speed engine operation, and the cam angle θ4 at which delivery terminates during low-speed engine operation are located, in the order mentioned, after the maximum velocity point.

As a result, the average cam velocity (fuel delivery rate) during high engine speed operation is greater than the average cam velocity (fuel delivery rate) during low engine speed operation.

Figure 31:
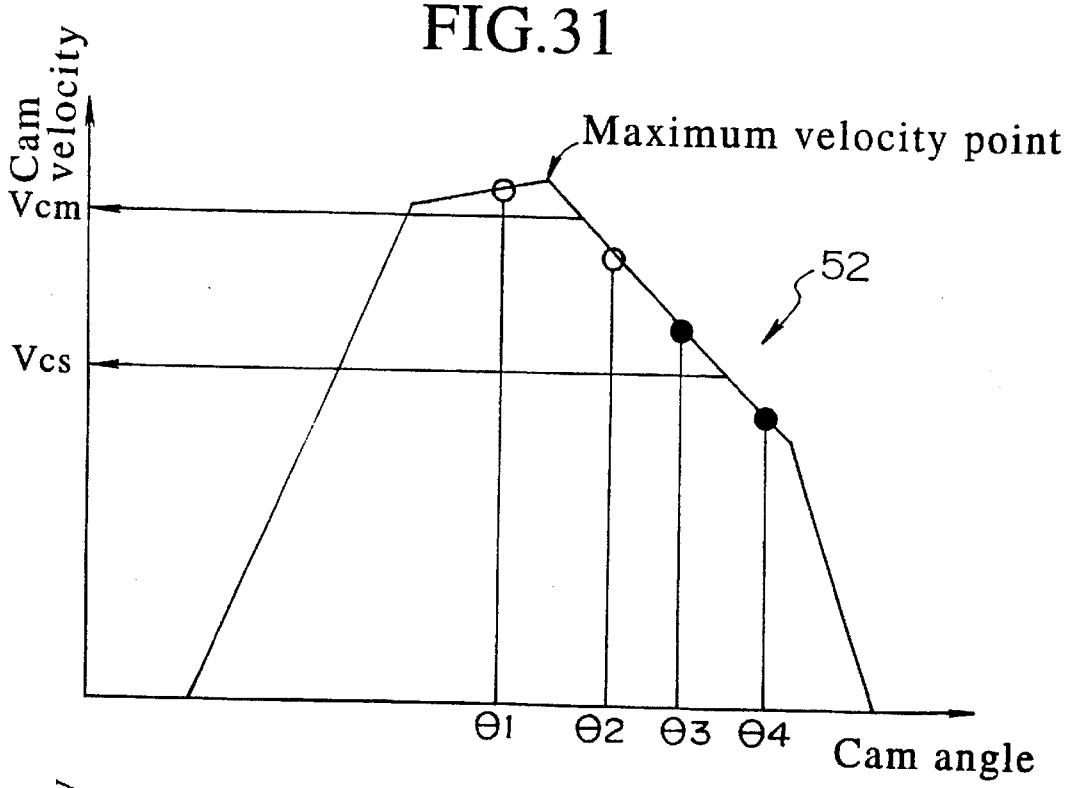
FIG. 31 is a graph showing how cam velocity varies with cam angle for a cam of profile 52 (fourteenth example).

FIG. 31 is a graph showing how cam velocity varies with cam angle for a cam of profile 52 (fourteenth example). As can be seen from this graph, the cam angle θ1 at which delivery of pressurized fuel starts during high-speed engine operation is located before the maximum velocity point, and the cam angle θ2 at which this delivery terminates, the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 32:
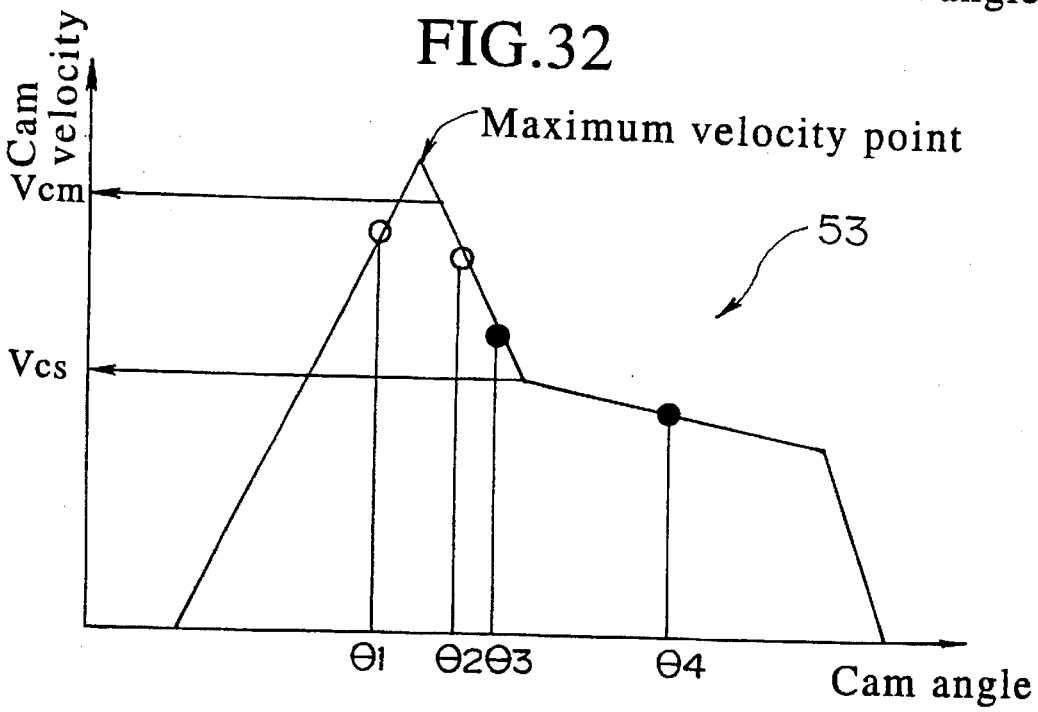
FIG. 32 is a graph showing how cam velocity varies with cam angle for a cam of profile 53 (fifteenth example).

FIG. 32 is a graph showing how cam velocity varies with cam angle for a cam of profile 53 (fifteenth example). As can be seen from this graph, the cam angle θ1 at which delivery of pressurized fuel starts during high-speed engine operation is located before the maximum velocity point, and the cam angle θ2 at which this delivery terminates, the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 33:
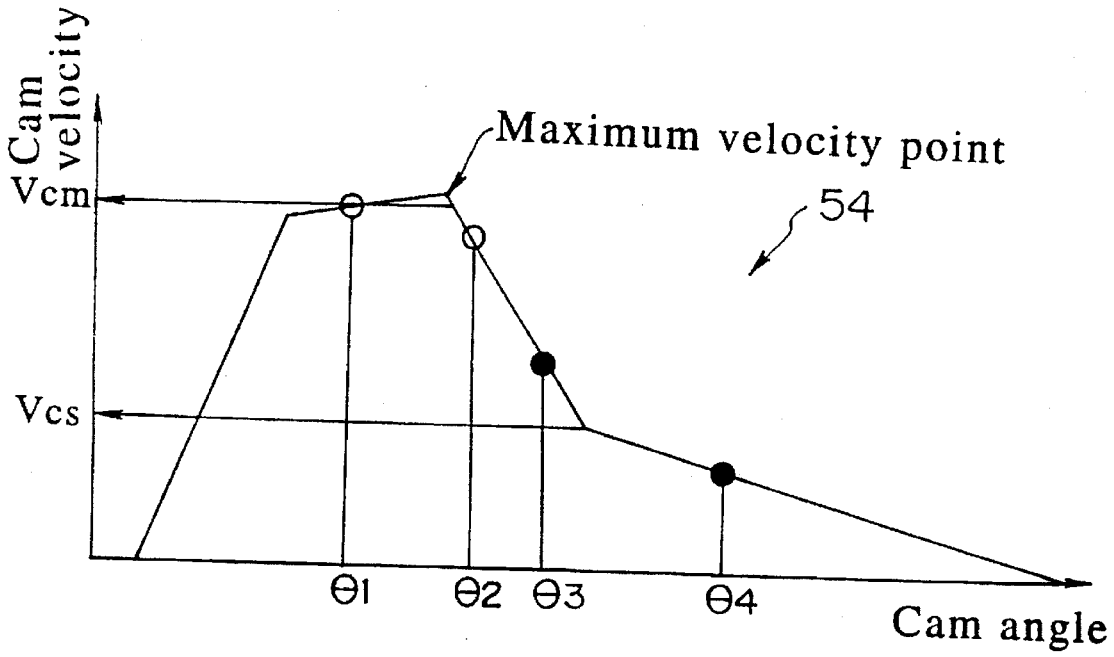
FIG. 33 is a graph showing how cam velocity varies with cam angle for a cam of profile 54 (sixteenth example).

FIG. 33 is a graph showing how cam velocity varies with cam angle for a cam of profile 54 (sixteenth example). As can be seen from this graph, the cam angle θ1 at which delivery of pressurized fuel starts during high-speed engine operation is located before the maximum velocity point, and the cam angle θ2 at which this delivery terminates, the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

Figure 34:
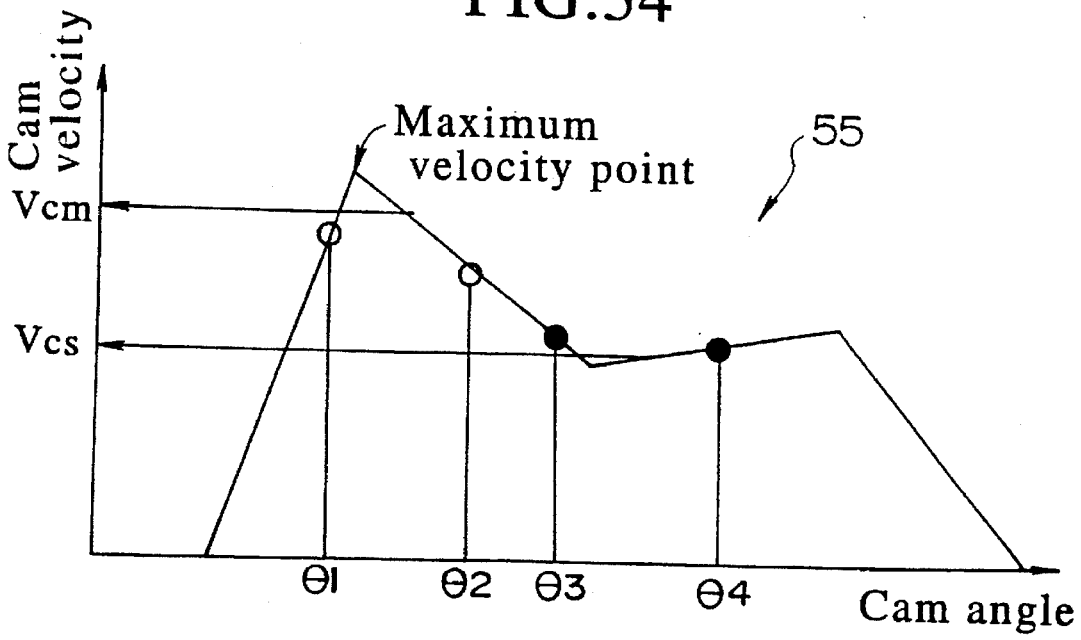
FIG. 34 is a graph showing how cam velocity varies with cam angle for a cam of profile 55 (seventeenth example).

FIG. 34 is a graph showing how cam velocity varies with cam angle for a cam of profile 55 (seventeenth example). As can be seen from this graph, the cam angle θ1 at which delivery of pressurized fuel starts during high-speed engine operation is located before the maximum velocity point, and the cam angle θ2 at which this delivery terminates, the cam angle θ3 at which delivery starts during low engine speed operation and the cam angle θ4 at which this delivery terminates are located, in the order mentioned, after the maximum velocity point.

As a result, the average cam velocity (fuel delivery rate) during high engine speed operation is greater than the average cam velocity (fuel delivery rate) during low engine speed operation.

As explained in the foregoing, in this invention it suffices to establish at least the region used by the plunger for delivery of pressurized fuel in the low engine speed region after the maximum velocity point of the cam by, for example, establishing at least the cam angle θ3 at which delivery starts during low engine speed operation and the cam angle θ4 at which this delivery terminates after the maximum velocity point.

In addition, it is permissible to start the delivery of pressurized fuel during high-speed engine operation before the maximum velocity point, and the order of fuel delivery termination during high-speed engine operation and fuel delivery start during low-speed engine operation can be selected as desired.

Moreover, the cam profile can be freely designed of, for example, an arc portion, a tangential portion, a nose portion and the like, and any of various cam profiles can be selected and combined with any of various plungers for obtaining the desired fuel injection characteristics.

As explained in the foregoing, since this invention uses a region of the cam following its maximum velocity point for fuel delivery, particularly during low-speed engine operation, and combines this use with use of a plunger exhibiting preflow effect, it achieves a reduction of the fuel delivery rate at low engine speed and an increase of the fuel delivery rate at high engine speed.

Particularly when applied to an indirect-injection type engine, the invention reduces the maximum fuel injection rate during engine operation at low-speed/high-load (torque point, low-speed torque point), thus reducing smoke generation and providing an improvement in torque that makes the engine ideal for use in a tractor or the like.

The invention fuel injection pump further reduces engine noise during low idling operation, reduces engine noise during low-load/middle-speed operation, reduces NOx emission at low-speed operation (low, middle and high load), and, for an equivalent fuel delivery rate during low-speed operation, improves the fuel delivery rate during high-speed engine operation to thereby achieve improved output at the rated point.

What is claimed is:

1. A fuel injection pump comprising a pump housing formed with a fuel reservoir, a cam attached to a cam shaft rotated by an engine, a plunger barrel mounted in the pump housing and formed with a fuel feed hole which communicates with the fuel reservoir, a plunger accommodated in the plunger barrel to be capable of sliding reciprocation and rotation therein and being formed with an inclined lead groove at a position for communication with the feed hole, and a fuel chamber formed between the plunger and the plunger barrel, reciprocation of the plunger by the cam causing fuel to be sucked into the fuel chamber from the fuel reservoir and delivered under pressure to a fuel injection nozzle, the fuel injection pump being characterized in that delivery of pressurized fuel by the plunger in a high engine speed region starts at an angle of the cam which precedes the angle thereof at which delivery of pressurized fuel by the plunger in a low engine speed region starts and that at least a pressurized fuel delivery region of the plunger in the low engine speed region is provided from at or after a maximum velocity point of the cam.

2. A fuel injection pump according to claim 1, wherein the engine is an indirect-injection type engine.

3. A fuel injection pump according to claim 1, wherein the plunger is a plunger capable of producing a preflow effect.

4. A fuel injection pump according to claim 1, wherein the cam is selected from one having a tangential portion, an arc portion and a nose portion and one not having a nose portion.

5. A fuel injection pump according to claim 1, wherein the main port of the plunger barrel is formed of a large-diameter main port and a small-diameter sub-port.

6. A fuel injection pump according to claim 5, wherein the plunger is formed with an upper sub-lead groove that can communicate with the sub-port.

7. A fuel injection pump according to claim 5, wherein the plunger is formed with an upper main lead groove that can communicate with the main port.

8. A fuel injection pump according to claim 5, wherein the plunger is formed with an inclined upper main lead groove that can communicate with the main port.

9. A fuel injection pump according to claim 5, wherein the sub-port is formed at the same level as the main port.

10. A fuel injection pump according to claim 5, wherein the sub-port is formed at a lower level than the main port.

11. A fuel injection pump according to claim 5, wherein the sub-port is formed at a higher level than the main port.

12. A fuel injection pump according to claim 1, wherein the main port of the plunger barrel is constituted of a large-diameter main port and a small-diameter sub-port formed within a range of opening of the main port in the axial direction of the plunger and an orifice is formed for communicating the sub-port with the fuel chamber.

13. A fuel injection pump according to claim 1, wherein a portion of the cam after the maximum velocity point is formed to obtain, in order, a cam angle θ1 at which delivery of pressurized fuel starts during high-speed engine operation, a cam angle θ2 at which this delivery terminates, a cam angle θ3 at which delivery of pressurized fuel starts during low engine speed operation and a cam angle θ4 at which this delivery terminates.

14. A fuel injection pump according to claim 1, wherein a portion of the cam before the maximum velocity point is formed to obtain a cam angle θ1 at which delivery of pressurized fuel starts during high-speed engine operation.

15. A fuel injection pump according to claim 1, wherein a portion of the cam before the maximum velocity point is formed to obtain a cam angle θ1 at which delivery of pressurized fuel starts during high-speed engine operation and a cam angle θ2 at which this delivery terminates.

16. A fuel injection pump according to claim 1, wherein a cam angle θ1 at which delivery of pressurized fuel starts during high-speed engine operation, a cam angle θ2 at which this delivery terminates, a cam angle θ3 at which delivery of pressurized fuel starts during low engine speed operation and a cam angle θ4 at which this delivery terminates are obtained in this order.

17. A fuel injection pump according to claim 1, wherein a cam angle θ1 at which delivery of pressurized fuel starts during high-speed engine operation, a cam angle θ3 at which delivery starts during low engine speed operation, a cam angle θ2 at which delivery terminates during high-speed engine operation, and a cam angle θ4 at which delivery terminates during low-speed engine operation are obtained in this order.

18. A fuel injection pump comprising a pump housing formed with a fuel reservoir, a cam attached to a cam shaft rotated by an engine, a plunger barrel mounted in the pump housing and formed with a fuel feed hole which communicates with the fuel reservoir, a plunger accommodated in the plunger barrel to be capable of sliding reciprocation and rotation therein and being formed with an inclined lead groove at a position for communication with the feed hole, and a fuel chamber formed between the plunger and the plunger barrel, reciprocation of the plunger by the cam causing fuel to be sucked into the fuel chamber from the fuel reservoir and delivered under pressure to a fuel injection nozzle, the fuel injection pump being characterized in that the feed hole of the plunger barrel is formed of a larger-diameter main port and a smaller-diameter sub-port and that at least a pressurized fuel delivery region of the plunger in a low engine speed region is provided from at or after a maximum velocity point of the cam.

19. A fuel injection pump according to claim 18, wherein a cam velocity of a region of the cam used for closing and opening the main port by the plunger is higher than a cam velocity of a region of the cam used for closing and opening the sub-port by the plunger.

20. A fuel injection pump comprising a pump housing formed with a fuel reservoir, a cam attached to a cam shaft rotated by an engine, a plunger barrel mounted in the pump housing and formed with a fuel feed hole which communicates with the fuel reservoir, a plunger accommodated in the plunger barrel to be capable of sliding reciprocation and rotation therein and being formed with an inclined lead groove at a position for communication with the feed hole, and a fuel chamber formed between the plunger and the plunger barrel, reciprocation of the plunger by the cam causing fuel to be sucked into the fuel chamber from the fuel reservoir and delivered under pressure to a fuel injection nozzle, the fuel injection pump being characterized in that a head portion of the plunger is formed with a stepped portion and that at least a pressurized fuel delivery region of the plunger in a low engine speed region is provided from at or after a maximum velocity point of the cam.

* * * * *